US011540653B2

(12) United States Patent
Haug

(10) Patent No.: US 11,540,653 B2
(45) Date of Patent: Jan. 3, 2023

(54) MULTI-PIECE STEMWARE

(71) Applicant: James Haug, Leesburg, VA (US)

(72) Inventor: James Haug, Leesburg, VA (US)

( * ) Notice: Subject to any disclaimer, the term of this patent is extended or adjusted under 35 U.S.C. 154(b) by 0 days.

(21) Appl. No.: 17/248,383

(22) Filed: Jan. 22, 2021

(65) Prior Publication Data

US 2022/0233005 A1 Jul. 28, 2022

(51) Int. Cl.
*A47G 19/22* (2006.01)

(52) U.S. Cl.
CPC .. *A47G 19/2255* (2013.01); *A47G 2019/2277* (2013.01)

(58) Field of Classification Search
CPC ..... A47G 19/2255; B65D 21/0234; B65D 21/0209; B65D 21/0212; B65D 21/0213; B65D 21/0214; B65D 21/0215; B65D 21/0219; B65D 21/0222; B65D 21/0223
See application file for complete search history.

(56) References Cited

U.S. PATENT DOCUMENTS

| | | | |
|---|---|---|---|
| 33,341 | A | 10/1868 | Towndrow |
| 35,834 | A | 1/1869 | Leach |
| 131,141 | A | 9/1872 | Will |
| 195,337 | A | 9/1877 | Braunstein |
| 600,427 | A | 3/1898 | Jones |
| 648,436 | A | 5/1900 | Rider |
| 782,710 | A | 2/1905 | Weller |
| 809,567 | A | 1/1906 | Henckel |
| 919,691 | A | 4/1909 | Cahill |
| 1,986,958 | A | 1/1935 | Abraham |
| 2,054,245 | A | 9/1936 | Cummins |
| 2,120,862 | A | 6/1938 | Michael |
| 2,169,426 | A | 8/1939 | Morton |
| 2,171,919 | A | 9/1939 | Dodge |
| 2,177,337 | A | 10/1939 | Alexander |
| 2,217,514 | A | 10/1940 | Henry |
| 2,224,319 | A | 12/1940 | Schroyer |

(Continued)

FOREIGN PATENT DOCUMENTS

| | | | |
|---|---|---|---|
| CA | 961785 | A | 1/1975 |
| CN | 203220193 | U | 10/2013 |

(Continued)

OTHER PUBLICATIONS

International Search Report and Written Opinion for PCT Application No. PCT/US2022/070173, dated Apr. 21, 2022, 15 pages.

*Primary Examiner* — Andrew T Kirsch
(74) *Attorney, Agent, or Firm* — Brake Hughes Bellermann LLP

(57) ABSTRACT

In a general aspect, a multi-piece vessel can include a body defining an interior volume, and a base. The body can include a closed end, and an open end opposite the closed end. The base can have a foot arranged in a plane. The base can include a stem arranged along a longitudinal axis that is orthogonal to the plane, and a first magnetic element disposed at an end of the stem. The multi-piece vessel can also include an attachment assembly coupled with the closed end of the body, the attachment assembly having a second magnetic element configured to form a magnetic coupling with the first magnetic element, and a retention feature defined on a surface of the attachment assembly distal from the body.

21 Claims, 22 Drawing Sheets

(56) References Cited

U.S. PATENT DOCUMENTS

| | | | |
|---|---|---|---|
| 2,532,181 | A | 11/1950 | Moore |
| 2,585,445 | A | 2/1952 | Dingeldein |
| 2,663,866 | A | 12/1953 | Simpson |
| 2,664,004 | A | 12/1953 | Sol et al. |
| 2,745,947 | A | 5/1956 | Leon |
| 2,918,188 | A | 12/1959 | Todd |
| 2,996,208 | A | 8/1961 | Schroeder |
| 3,013,688 | A | 12/1961 | Luning |
| 3,079,037 | A | 2/1963 | Alfred |
| 3,089,605 | A | 5/1963 | Buonauro |
| 3,091,360 | A | 5/1963 | Bryant |
| 3,218,447 | A | 11/1965 | Edward |
| 3,325,048 | A | 6/1967 | Bryant |
| 3,347,411 | A | 10/1967 | Kalata et al. |
| 3,369,687 | A | 2/1968 | Walls |
| 3,374,344 | A | 3/1968 | Rudolph et al. |
| 3,393,819 | A | 7/1968 | De et al. |
| 3,441,173 | A | 4/1969 | Edwards |
| 3,482,731 | A | 12/1969 | Douty |
| 3,526,335 | A | 9/1970 | Swett et al. |
| 3,735,113 | A | 5/1973 | Stott |
| 3,784,052 | A | 1/1974 | Edwards |
| 3,878,386 | A | 4/1975 | Douglas |
| 3,934,725 | A | 1/1976 | Edwards |
| 3,987,930 | A | 10/1976 | Fuson |
| 4,344,113 | A | 8/1982 | Ditto et al. |
| 4,563,726 | A | 1/1986 | Newcomb et al. |
| 4,922,355 | A | 5/1990 | Dietz et al. |
| 5,014,865 | A | 5/1991 | Sauber |
| 5,070,435 | A | 12/1991 | Weller |
| 5,119,279 | A | 6/1992 | Makowsky |
| 5,146,957 | A | 9/1992 | Belokin et al. |
| 5,160,031 | A | 11/1992 | Palisin et al. |
| 5,178,450 | A | 1/1993 | Zelensky et al. |
| 5,211,699 | A | 5/1993 | Tipton |
| 5,287,979 | A | 2/1994 | Bourgeois |
| 5,292,018 | A | 3/1994 | Travisano |
| 5,339,548 | A | 8/1994 | Russell |
| 5,504,663 | A | 4/1996 | Tucker |
| 5,513,764 | A | 5/1996 | Harrison et al. |
| 5,575,553 | A | 11/1996 | Tipton |
| 5,586,647 | A | 12/1996 | Barta et al. |
| 5,609,409 | A | 3/1997 | Diehl |
| 5,624,177 | A | 4/1997 | Rosaia |
| 5,671,998 | A | 9/1997 | Collet |
| 5,785,407 | A | 7/1998 | Ratcliffe et al. |
| 5,842,590 | A | 12/1998 | Gordon et al. |
| 5,879,068 | A | 3/1999 | Menashrov et al. |
| 5,931,558 | A | 8/1999 | Chen |
| 5,996,825 | A | 12/1999 | Gordon et al. |
| 6,062,380 | A | 5/2000 | Dorney |
| 6,065,848 | A | 5/2000 | Tucker et al. |
| 6,092,905 | A | 7/2000 | Koehn |
| 6,163,248 | A | 12/2000 | Paek et al. |
| 6,164,473 | A | 12/2000 | Waldrip |
| 6,213,301 | B1 | 4/2001 | Landis et al. |
| 6,213,616 | B1 | 4/2001 | Chien |
| 6,305,656 | B1 | 10/2001 | Wemyss |
| 6,352,352 | B1 | 3/2002 | Schletterer et al. |
| 6,371,624 | B1 | 4/2002 | Dorney |
| 6,409,374 | B1 | 6/2002 | Willat |
| 6,416,198 | B1 | 7/2002 | Vanderschuit |
| 6,511,197 | B1 | 1/2003 | Kalemjian |
| 6,640,989 | B2 | 11/2003 | Matsui |
| 6,644,846 | B2 | 11/2003 | Willat |
| 6,662,959 | B1 | 12/2003 | Westerhold |
| 6,746,132 | B2 | 6/2004 | Liu |
| 6,758,058 | B1 | 7/2004 | Citrynell et al. |
| 6,955,443 | B2 | 10/2005 | Solowiej |
| D514,387 | S | 2/2006 | Rockwell |
| 7,861,888 | B2 | 1/2011 | Niedzwiecki |
| 7,976,177 | B2 | 7/2011 | Dikopf |
| 8,829,824 | B2 | 9/2014 | Scott |
| 9,044,112 | B2 | 6/2015 | Lee |
| 9,157,573 | B1 | 10/2015 | Zach et al. |
| 10,479,555 | B2 | 11/2019 | Lee |
| 2002/0104819 | A1 | 8/2002 | Matsui |
| 2003/0098311 | A1 | 5/2003 | Parentini |
| 2004/0001332 | A1 | 1/2004 | Solowiej |
| 2004/0202751 | A1 | 10/2004 | McKay et al. |
| 2005/0092759 | A1 | 5/2005 | Willat et al. |
| 2005/0139570 | A1 | 6/2005 | Lambert et al. |
| 2008/0128429 | A1 | 6/2008 | Towery et al. |
| 2008/0179328 | A1 | 7/2008 | Anderson |
| 2008/0264958 | A1 | 10/2008 | Blake |
| 2009/0261093 | A1* | 10/2009 | Fullerton ..... B25H 3/021 220/4.28 |
| 2011/0174763 | A1 | 7/2011 | Kennedy |
| 2013/0020333 | A1 | 1/2013 | Scott |
| 2013/0259984 | A1 | 10/2013 | Eves |
| 2013/0334166 | A1 | 12/2013 | Garipalli et al. |
| 2014/0054304 | A1 | 2/2014 | Hu |
| 2014/0291335 | A1* | 10/2014 | Lee ..... A47G 19/2205 220/630 |
| 2017/0057694 | A1* | 3/2017 | Moore ..... B65D 21/0209 |
| 2018/0098653 | A1 | 4/2018 | Pinchuk |
| 2018/0255949 | A1 | 9/2018 | Fritz |
| 2019/0256252 | A1* | 8/2019 | Mundy ..... B65D 21/0223 |

FOREIGN PATENT DOCUMENTS

| | | | |
|---|---|---|---|
| DE | 56453 | C | 4/1891 |
| DE | 102019114841 | A1 | 12/2020 |
| EP | 0012009 | A2 | 6/1980 |
| EP | 2789273 | A1 | 10/2014 |
| FR | 357416 | A | 12/1905 |
| FR | 531097 | A | 1/1922 |
| FR | 625913 | A | 8/1927 |
| FR | 696970 | A | 1/1931 |
| FR | 885381 | A | 9/1943 |
| FR | 1236001 | A | 7/1960 |
| JP | S51159285 | U | 12/1976 |
| JP | 2001039445 | A | 2/2001 |
| JP | 3148886 | U | 2/2009 |
| KR | 1020080006233 | | 1/2008 |
| KR | 200455115 | Y1 | 8/2011 |

* cited by examiner

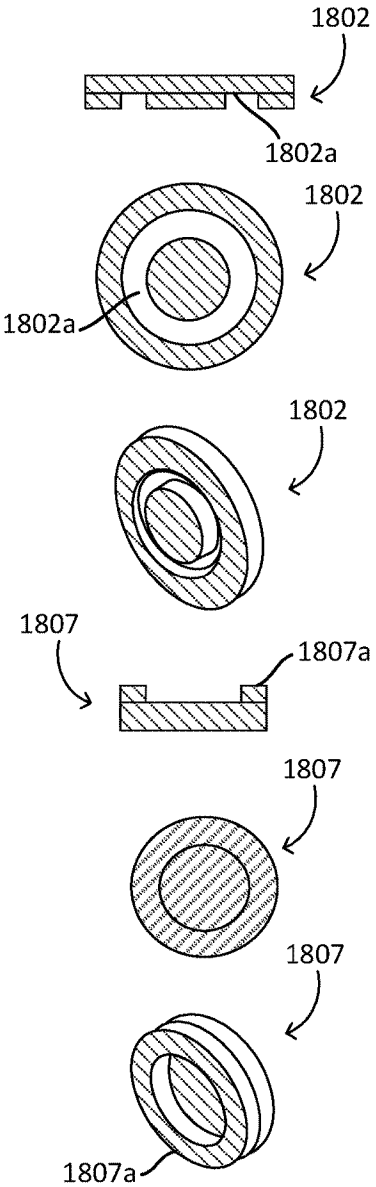
FIG. 18B
FIG. 18C
FIG. 18D
FIG. 18E
FIG. 18F
FIG. 18G
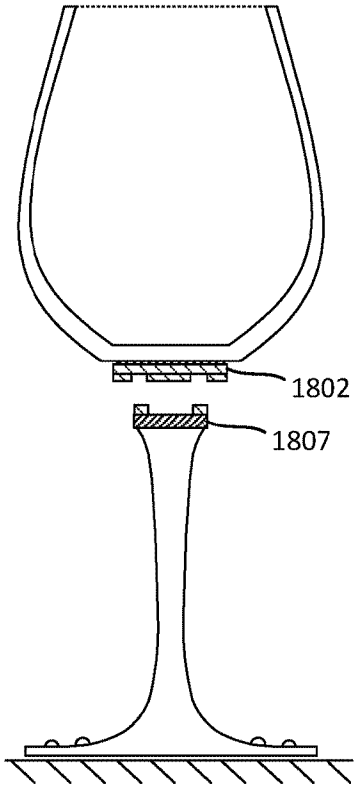
FIG. 18A

MULTI-PIECE STEMWARE

TECHNICAL FIELD

This disclosure relates generally to receptacles, such as beverageware. More specifically, this disclosure is related to receptacles that are multi-piece.

BACKGROUND

Vessels, such as stemware vessels, etc., with detachable bases (bases, stemmed bases, etc.) can provide certain advantages over conventional stemware that include permanently attached bases. Such advantages can include the ability to store the base and body separately, or in a more compact arrangement, the ability to wash and clean the body separately from the base, the ability to manufacture the base from materials that are different from the body material, and/or the ability to replace individual elements if either the body or base is damaged or misplaced.

However, current implementations of multi-piece vessels with detachable bases, which can be referred to herein as collapsible stemware, have certain disadvantages. For instance, a number of current implementations employ compression, friction or threaded connections for attachment of a base with a corresponding vessel body. Such approaches involve rotating, snapping, and or press-fitting the base and/or vessel to effect attachment for use of the vessel, e.g., to hold and/or consume liquids or other substances. Such attachment approaches can result in damage to the base or vessel, such as at an attachment point of the base and vessel body, and/or can limit the materials that are suitable for producing such collapsible vessels. Also, such approaches may not allow for secure storage of the base and vessel body, when separated, which can result in damage to the base and/or the body vessel.

Current approaches can have other disadvantages, such as insufficient strength of coupling between a vessel's base and body, susceptibility to damage at a connection point between the base and body, damage due to difference in thermal expansion properties of different material, inability to use body vessels separately from their corresponding bases, e.g., as freestanding vessels, lateral sliding of the base relative to the vessel body, and/or limited stability of the vessel due to the sizing of a foot included in the base, e.g., where the foot is sized to fit within and inner perimeter of an opening in the vessel body when storing the vessel in a collapsed arrangement.

SUMMARY

In a general aspect, a multi-piece vessel can include a body defining an interior volume. The body can include a closed end, and an open end opposite the closed end. The multi-piece vessel can further include a base having a foot arranged in a plane. The base can include a stem arranged along a longitudinal axis that is orthogonal to the plane, and a first magnetic element disposed at an end of the stem that is distal from the foot. The multi-piece vessel can also include an attachment assembly coupled with the closed end of the body, the attachment assembly having a second magnetic element configured to form a magnetic coupling with the first magnetic element, and a retention feature defined on a surface of the attachment assembly distal from the body. The retention feature can be configured to reduce lateral movement of the base relative to the body while the base is magnetically coupled with the attachment assembly.

BRIEF DESCRIPTION OF THE DRAWINGS

FIGS. 16A-16G, 17A-17G and 18A-18G are diagrams illustrating respective magnetic attachment assemblies that can be included in a collapsible vessel.

Figure 1:
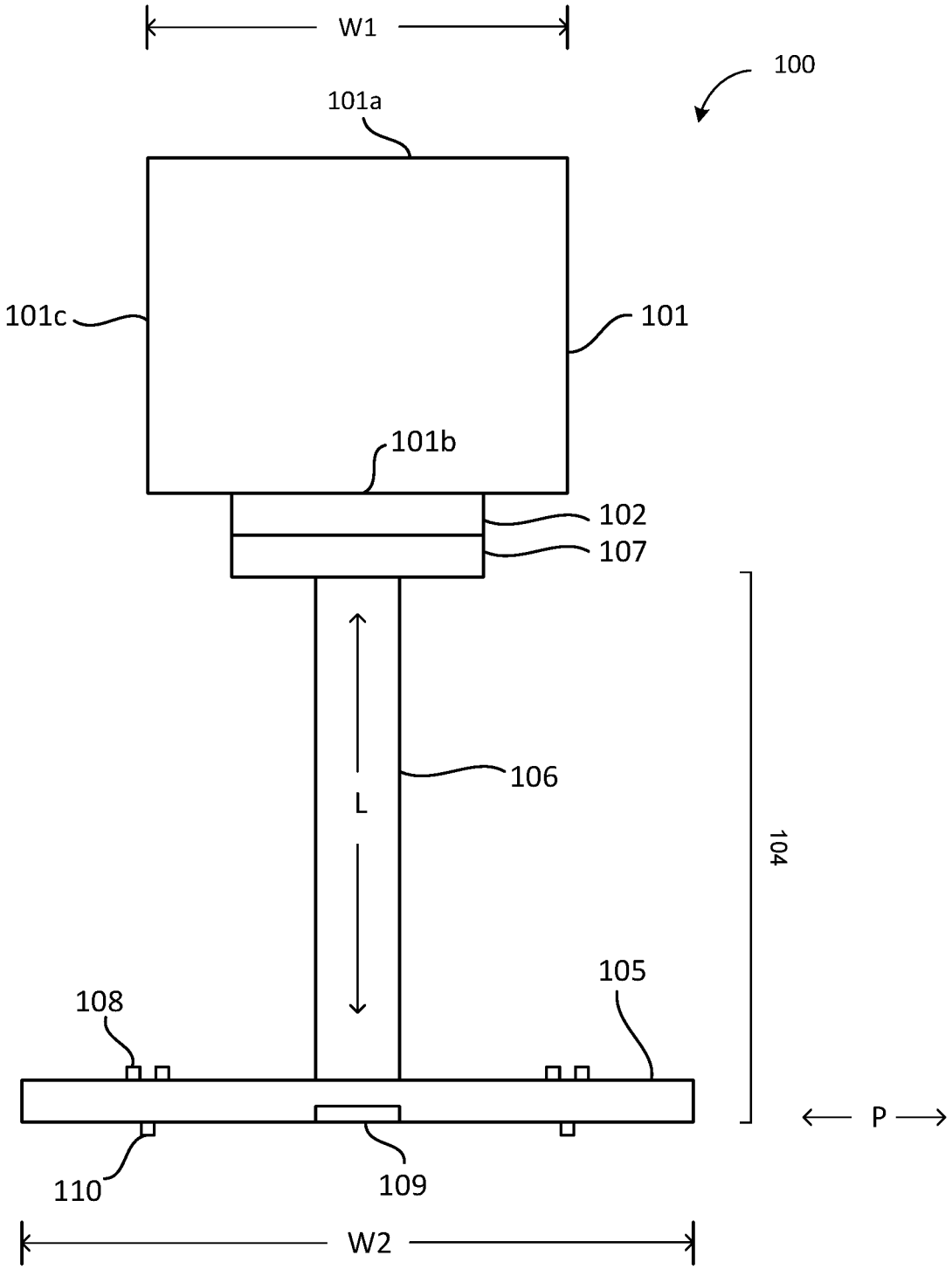
FIG. 1 is a diagram schematically illustrating a collapsible stemware vessel.

In the drawings, which may not necessarily be to scale, reference numbers for like or similar elements may not be shown for each of those elements. Also, reference numbers from one view of a given implementation may not be repeated in the related views. Further, in some instances, for purposes of comparing different views, reference numbers from one view of a given implementation may be repeated in other views, but may not be specifically discussed with respect to each view.

DETAILED DESCRIPTION

Detailed embodiments are disclosed herein. However, it is understood that the disclosed embodiments are merely examples, which may be embodied in various forms. Therefore, specific structural and functional details disclosed herein are not to be interpreted as limiting, but merely as a basis for the claims and as a representative basis for teaching one skilled in the art to variously employ the embodiments in virtually any appropriately detailed structure. Further, the terms and phrases used herein are not intended to be limiting, but to provide an understandable description of the present disclosure.

The terms "a" or "an," as used herein, are defined as one or more than one. The term "another," as used herein, is defined as at least a second or more. The terms "including" and/or "having", as used herein, are defined as comprising (i.e., open transition). The term "coupled" or "moveably coupled," as used herein, is defined as connected, although not necessarily directly and mechanically.

This disclosure is directed to collapsible beverageware implementations, such as collapsible stemware, such wineglasses, or martini glasses, that address at least some of the drawbacks of current approaches discussed above. The implementations described herein are directed to vessels that can include a vessel body, where the vessel body has an inner volume that can be used for receiving, holding, pouring dispensing and/or consuming liquids or other substances. The implementations described herein can further include a base, e.g., a stemmed based, that is attachable and detachable from the vessel body using at least one magnetic connection. In some implementations, a vessel base and a corresponding vessel body can be coupled, such as magnetically attached or magnetically coupled, with each other in at least two configurations.

For instance, in a first configuration, a base can be magnetically coupled to a bottom, or closed end of a vessel body, e.g., to function as a stemware vessel, such as a stemmed wine glass. In a second configuration, the base can be detached and separated from the vessel body. The use of one or more magnetic connections avoids having to rotate, snap, and or push the base and body together to form a connection between the body and the base, and also enables easy attachment and detachment of the base and vessel body, and can allow for separate and convenient placement of the base and vessel body in a dishwasher, such as a compact dishwasher, for cleaning.

In a third configuration the base can be inserted, or nested inside the vessel body for compact storage and/or transport. In the third configuration, a magnetic coupling force between the base, including a first magnetic element, and the vessel body, including a second magnetic element, can help secure the base in the body, e.g., for storage of the collapsed and nested vessel, which can provide an advantage over current approaches. Such implementations, as described herein, can allow for a foot included in a vessel base to be of a larger width or diameter than an opening of the body. This can provide improved stability of a corresponding vessel, e.g., in a stemware configuration, over some current implementations, where a foot with a diameter equal to, or substantially equal to a diameter of an opening in a corresponding vessel body is used, which allows the foot to rest within an inner perimeter of the opening of the body in a nested configuration.

In some implementations, an attachment assembly, including a magnetic element, can be coupled with the vessel body. That is, in some implementations, an attachment assembly can be configured to conform and attach to a surface profile of a closed end, or bottom surface of a vessel body. Such an attachment assembly can be configured to facilitate a magnetic attachment between the vessel body and the base, in multiple configurations, such as those discussed herein. Use of such attachment assemblies can also allow for increased connection strength between a vessel base and a vessel body, such as by appropriate sizing of an included magnetic element, as compared to current approaches. Such attachment assemblies, and/or corresponding bases can also include retention features, which can be complimentary retention features or cooperative retention features, that can prevent lateral movement of a vessel's base relative the vessel's body, e.g., in a stemware configuration, when the vessel is manipulated during use, such as to swirl liquids, consume liquids, etc.

Additionally, as described herein, such attachment assemblies can be configured to allow for use of a vessel body as a freestanding vessel without a corresponding base attached, which can provide an advantage over current approaches that include vessel bodies that are not usable as freestanding vessels. That is, in some implementations, a vessel body, such as a vessel body with a rounded bottom, can be used as a freestanding vessel with an attachment assembly coupled with the rounded bottom.

In addition to the advantages briefly noted above, which are discussed in further detail below, at least some of the implementations described herein can be configured to allow for multiple vessels, in their nested (collapsed) configuration, to be stacked on top of each other. For instance, in some implementations, nested vessels can be stacked with each other in like orientations and/or in alternating orientations, such as for compact storage and transport. In some implementations, respective magnetic elements included in, on, within, or coupled to the vessel base, the vessel body, and/or included in one or more attachment assemblies can, in addition to providing magnetic coupling in the configurations described above, also provide magnetic coupling to help retain multiple nested vessels in stacked arrangements. Still further, in some implementations, such magnetic elements can also facilitate the attachment of magnetic or magnetically attractive features, such as ornamental features, to the vessel base and/or the vessel body, which can help users to distinguish one vessel from another like vessel, such as during a social gathering.

FIG. 1 is a diagram schematically illustrating a collapsible stemware vessel 100. As shown in FIG. 1, the collapsible stemware vessel 100 includes a vessel body 101 and a base 104 that is coupled with the vessel body 101 in a stemware configuration. The vessel body 101 can be configured to hold fluids and/or other substances. In this example implementation, the vessel body 101 is coupled (e.g., magnetically coupled) with the base 104 via a first magnetic element 102 and a second magnetic element 107. In some implementations, the first magnetic element 102 and the second magnetic element 107 can each include a magnet and/or a magnetically attractive material. The first magnetic element 102 and/or the second magnetic element 107, in some implementations, can be included in respective attachment assemblies that can include retention features or mechanisms, where such retention features can help prevent lateral movement (sliding or relative lateral movement) of the base 104 relative to the body 101 when the collapsible stemware vessel 100 is in use and/or in a nest configuration. Depending on particular implementation, an attachment assembly can be coupled with a vessel body and/or a stem of a vessel base using an adhesive connection, a compression connection, a friction connection, an interference connection, etc. Example attachment assembly implementations and respective retention features are shown in, at least, FIGS. 2A-10C and 16A-18G.

As shown in FIG. 1, the vessel body 101 can include an open end 101*a*, a closed end (a bottom end 101*b*) and a side 101*c*. The side 101*c* can define a circumferential side surface of the vessel body 101 and, in combination with the bottom end 101*b*, can define an inner volume of the vessel body 101 for receiving, holding, dispensing and/or consuming liquids and/or other substances. The shape of the vessel body 101 shown in FIG. 1, as well as the other elements of the collapsible stemware vessel 100, and the elements of other example implementations, are shown as examples, and other shapes can be used.

The base 104 of the collapsible stemware vessel 100, as illustrated in FIG. 1, can include a foot 105, which can provide a generally planar support, or foundation for the collapsible stemware vessel 100. For instance, as shown in FIG. 1, the foot 105 can be arranged, or generally arranged in a plane P. The base 105 of the collapsible stemware vessel 100 also includes a stem 106 that is arranged along a longitudinal axis L, which is orthogonal with the plane P. In the collapsible stemware vessel 100, the second magnetic element 107 of the base 104 is disposed at an end of the stem 106 that is distal or opposite from the foot 105. As noted above, the second magnetic element 107, in some implementations, includes a magnet and/or a magnetically-attractive material, which can, depending on the implementation, be included in an attachment assembly including retention features that are embedded in the stem 106, coupled with the stem 106, etc.

As shown in FIG. 1, in this example, the foot 105 of the base 104, such as on an upper surface of the foot 105, includes alignment features 108, which can be configured to prevent lateral movement of the vessel body 101 relative to the foot 105 when the collapsible stemware vessel 100 is arranged in a nested configuration with the vessel body 101 resting on the foot 105. While the alignment features 108 of the collapsible stemware vessel 100 are shown as raised features, in some implementations, the alignment features 108 can include raised and/or recessed features, such as protrusions, grooves, etc. As shown in FIG. 1, the vessel body 101 has a width W1 that is less than a width W2 of the foot 105. As noted above, such an arrangement can provide stability to the collapsible stemware vessel 100 when in use, while the alignment features 108, in addition to magnetic coupling, can provide lateral stability when the collapsible stemware vessel 100 is in a nested configuration.

In this example, the foot 105 of the base 104 also includes an opening 109, which can be configured to receive another magnetic element, e.g., for providing stability when stacking nested vessels, such as shown in, at least, FIGS. 14A-15D, and/or can facilitate attachment of ornamental elements with the foot 105. As with the first magnetic element 102 and the second magnetic element 107, a magnetic element disposed in the opening 109 can include a magnet and/or a magnetically-attractive material.

The collapsible stemware vessel 100 of FIG. 1 also further includes one or more alignment features 110 disposed on a bottom side of the foot 105, e.g., a side of the foot 105 distal from, or opposite the stem 106. As with the alignment features 108, the alignment features 110 can also include raised and/or recessed features, depending on the particular implementation. The alignment features 110 can provide stability, alone or in combination with a magnetic element disposed in the opening 109, for multiple vessels in a stacked configuration, such as shown in, at least, FIGS. 14A-15D.

FIGS. 2A-2C, 3A-3C, 4A-4C, 5A-5C, 6A-6C, 7A-7C, 8A-8C, 9A-9C and 10A-10C are diagrams illustrating respective attachment assemblies that can include magnets and/or magnetically attractive materials. Such attachment assemblies can be included in collapsible vessels, such as those disclosed herein. As noted above, depending on the particular implementation, the attachment assemblies of FIG. 2A-10C, or other attachment assemblies, can be used to respectively implement, or can respectively include the first magnetic element 102 and/or the second magnetic element 107 of the collapsible stemware vessel 100. Further, one or both magnetic elements can include retention features. In some implementations, such retention features can interface with a portion, e.g., an end of a stem included in vessel base, or with complimentary retention features of another attachment assembly. In some implementations, such attachment assemblies, or portions of an attachment assembly can be painted, coated, or encapsulated in a protective coating to prevent corrosion or surface blemishes, and/or to provide different colors for decorative purposes.

Such retention features, as discussed above, in some implementations, can be cooperative and/or complimentary retention features, where retention features of an attachment assembly coupled with a vessel body operate cooperatively intermesh or interface with retention features included in a like, and/or complimentary attachment assembly included on a stem of a corresponding vessel base. Examples of such complimentary attachment assemblies are shown in, at least, FIGS. 4A-4C, 8A-8C, 9A-9C and 10A-10C, as well as in FIGS. 16A-18B.

In the following discussion of FIGS. 2A-10C, the example attachment assemblies can include similar elements and/or features. Accordingly, for purposes of brevity, those features may not be discussed in detail with respect to each example implementation. Also, the cross-sectional views of the example implementations of FIGS. 2A-10C are taken along section lines consistent with the section line C-C of FIG. 2B. Accordingly, for purpose of brevity, a section line is not shown or described with respect to each example implementation.

Because, in the example implementations described here, lateral retention features are included in, for example, an attachment assembly that is coupled with a vessel body or vessel base, the body and base can exclude integrated retention features, such as integrated grooves, protrusions, and/or partial stems used in current implementations. Such approaches can simplify manufacturing of a vessel body and/or vessel base, and also reduce a risk of damage to such integrated retention features at a connection point between a body and base of a collapsible stemware vessel. Further, the example approaches described herein can allow for different materials than the vessel body and/or vessel base to be used for the retention features, where such materials can be selected to prevent damage from shear stress or lateral loads better than materials that may be used for the body and/or the base.

Figure 2A:
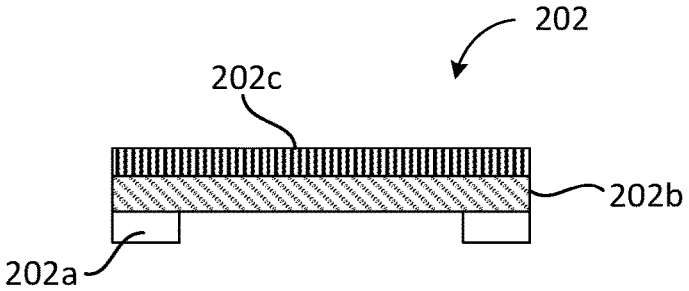
FIGS. 2A-2C, 3A-3C, 4A-4C, 5A-5C, 6A-6C, 7A-7C, 8A-8C, 9A-9C and 10A-10C are diagrams illustrating respective magnetic and/or magnetically attractive assemblies that can be included in collapsible vessels, such as those disclosed herein.
Figure 2B:
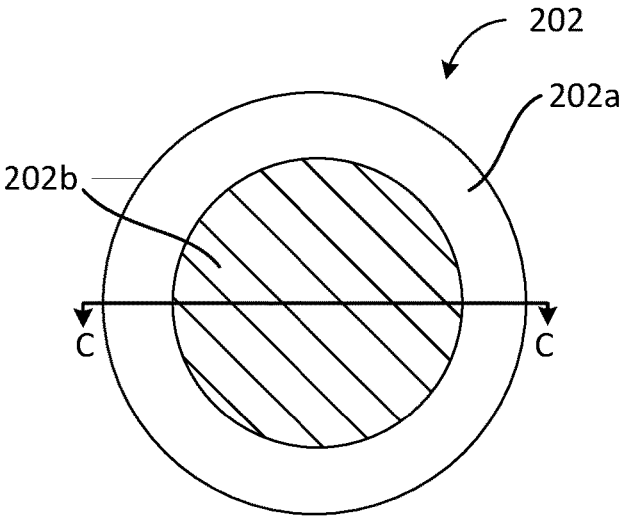
Figure 2C:
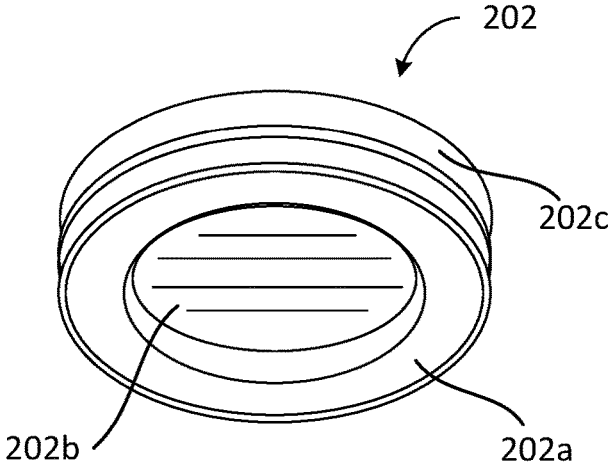

Referring to FIGS. 2A-2C, an example attachment assembly 202 is shown. In some implementations, the attachment assembly 202 (or other attachment assemblies) can be attached to an outer surface of a vessel body, such as a closed end of the vessel body, e.g., a bottom, or outer surface of the bottom end 101*b* of the vessel body 101 in FIG. 1, and/or or to a stem of a vessel base, such as an end of the stem 106 distal from the foot 105 of the base 104. FIG. 2A is a diagram that illustrates a cross-sectional view, along a section line C-C in FIG. 2B of the attachment assembly 202. FIG. 2B is a diagram that illustrates a plan view of the attachment assembly 202, while FIG. 2C is a diagram that illustrates a perspective view of the attachment assembly 202. FIGS. 3A-10C illustrate like views, as in FIGS. 2A, 2B and 2C, of their respective attachment assemblies.

As shown in FIGS. 2A-2C, the attachment assembly 202 includes a magnetic element 202*b*, which can include a magnet and/or a magnetically-attractive material, such as a metal. As further shown in FIGS. 2A-2C, the attachment assembly 202 includes a retention feature 202*a*, which is implemented as a raised feature (a ring) in this example.

Depending on the particular implementation, such retention features can be formed unitarily or monolithically with an associated magnetic element, or can be implemented using a separate element that is coupled with the magnetic element, such as the ring used to implement the lateral retention feature 202*a*, and can include raised and/or recessed features.

In this example, the attachment assembly 202 also includes an attachment element 202*c*, which can, in some implementations be contoured, or shaped to correspond with a contour, or other shape of a corresponding vessel body with which the attachment assembly 202 is configured to be coupled to. In some implementations, a vessel body can have a flat, curved, or conical shape. In some implementations, the attachment assembly 202 can include the lateral retention feature 202*a* and the magnetic element 202*b*, and omit a separate attachment element 202*c*. In such implementations, the magnetic element 202*b* could be shaped to match a contour of a corresponding vessel body or vessel stem included in a vessel base. Depending on the particular implementation, such as for implementations including a separate attachment element, the attachment element 202*c* can be formed of a same material, or of a different material than a corresponding vessel body, or vessel stem to which it is coupled. Further, in some implementations, the attachment element 202*c* can be integrated, and/or monolithically formed with the retention feature 202*a*.

Attachment assemblies coupled with a vessel body of a collapsible stemware vessel, such as the attachment assembly 202, can be configured such that they fit over and/or cooperatively interface, interweave, or intermesh with a magnetic element and/or a complimentary attachment assembly included in a corresponding vessel base, e.g., which can be disposed at an end of a stem of the vessel base. In such implementations, when a magnetic connection is made between the vessel body and the vessel base, the magnetic force can retain the vessel body and the vessel base in a coupled, stemware arrangement, and corresponding retention features, such as those described herein, can prevent lateral movement (e.g., sliding) of the vessel base relative to the vessel body when the vessel is in use.

Figure 3A:
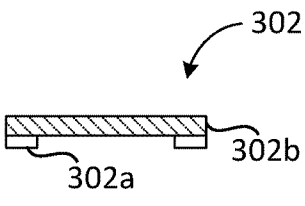
Figure 3B:
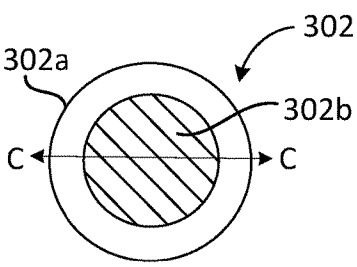
Figure 3C:
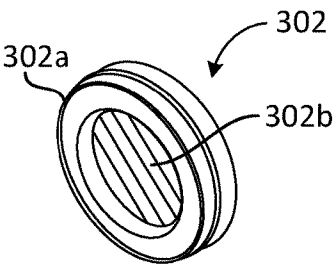

FIGS. 3A, 3B and 3C are diagrams that illustrate, respectively, a cross-sectional view, a plan view and a perspective view of an attachment assembly 302 that, similar to the attachment assembly 202, includes a magnetic element 302*b* and a retention feature 302*a* that includes a raised ring disposed around an outer perimeter of the magnetic element 302*b*. As compared with the attachment assembly 202, the attachment assembly 302 omits, or excludes a separate attachment element, such as the attachment element 202*c*.

Figure 4A:
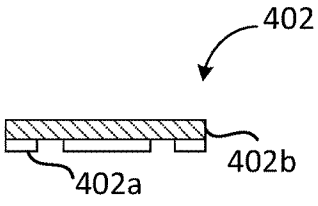
Figure 4B:
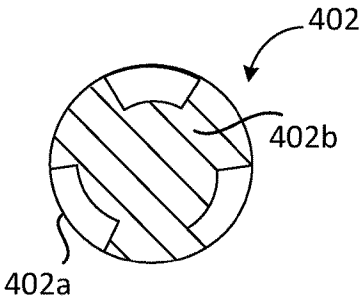
Figure 4C:
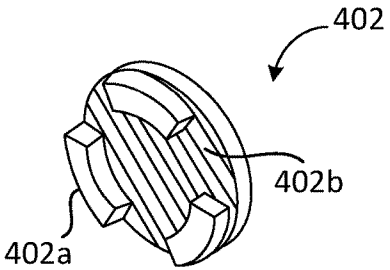

FIGS. 4A, 4B and 4C are diagrams that illustrate, respectively, a cross-sectional view, a plan view and a perspective view of an attachment assembly 402 that, includes a magnetic element 402*b* and retention features 402*a* that include raised features that extend only partially around an outer perimeter of the magnetic element 402*b*. As noted above, when a magnetic connection is made between a vessel body and a vessel base, the magnetic force can retain the vessel body and the vessel base in a coupled, stemware arrangement and the retention features 402*a* of the attachment assembly 402 can, in some implementations, cooperatively interface with like retention features, such as retention features 402*a* included on a stem of a vessel base, e.g., to prevent lateral movement of the base relative to the vessel body.

Figure 5A:
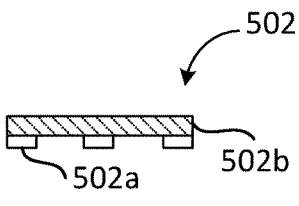
Figure 5B:
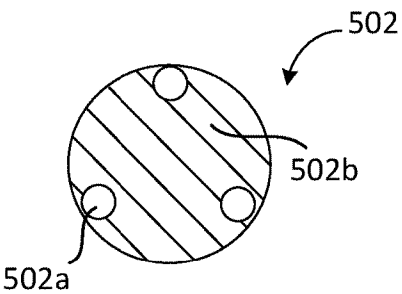
Figure 5C:
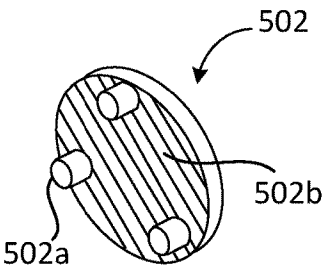

FIGS. 5A, 5B and 5C are diagrams that illustrate, respectively, a cross-sectional view, a plan view and a perspective view of an attachment assembly 502 that, includes a magnetic element 502*b* and retention features 502*a* that are implemented as raised pin features distributed around an outer perimeter of the magnetic element 502*b*. The retention features 502*a* of the attachment assembly 502 can, when a corresponding vessel body is magnetically coupled with a vessel base, be disposed around an end of a stem of the base, with the end of the stem being disposed within the pins, which can prevent lateral movement of the base relative to the vessel body.

Figure 6A:
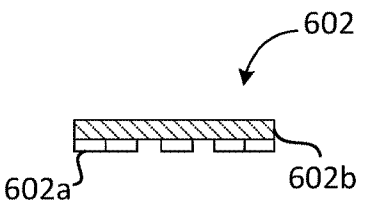
Figure 6B:
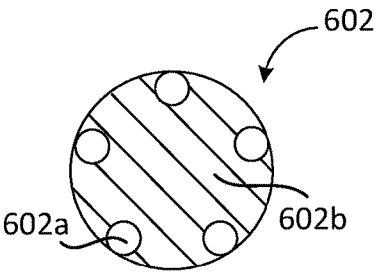
Figure 6C:
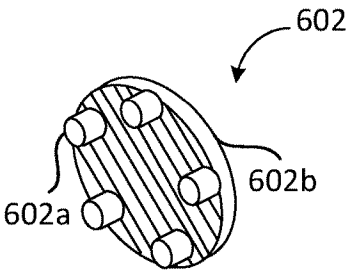

FIGS. 6A, 6B and 6C are diagrams that illustrate, respectively, a cross-sectional view, a plan view and a perspective view of an attachment assembly 602 that, similar to the attachment assembly 502, includes a magnetic element 602*b* and retention features 602*a* that are raised pin features distributed around an outer perimeter of the magnetic element 602*b*. The retention features 602*a* of the attachment assembly 602 can, when a corresponding vessel body is magnetically coupled with a vessel base, be disposed around an end of a stem of the base, which can prevent lateral movement of the base relative to the vessel body.

Figure 7A:
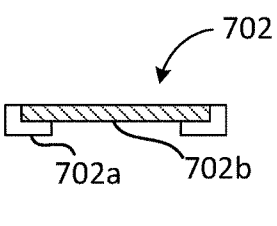
Figure 7B:
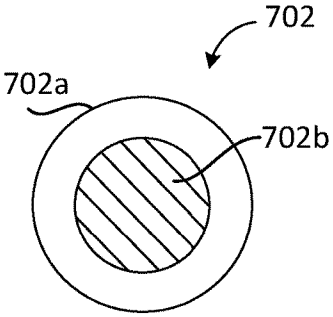
Figure 7C:
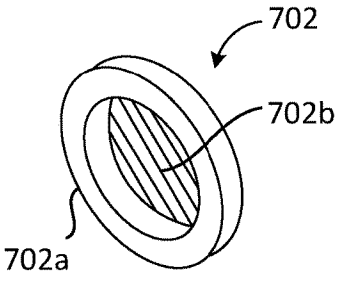

FIGS. 7A, 7B and 7C are diagrams that illustrate, respectively, a cross-sectional view, a plan view and a perspective view of an attachment assembly 702 that, similar to the attachment assemblies 202 and 302, includes a magnetic element 702*b* and a retention feature 702*a* that includes a raised ring disposed around an outer perimeter of the magnetic element 702*b*. As compared with the attachment assemblies 202 and 702, in the attachment assembly 702, the magnetic element 702*b* is inset in the retention feature 702*a*.

Figure 8A:
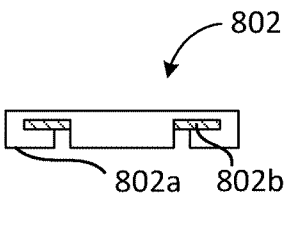
Figure 8B:
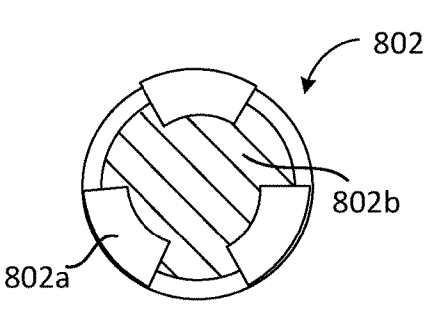
Figure 8C:
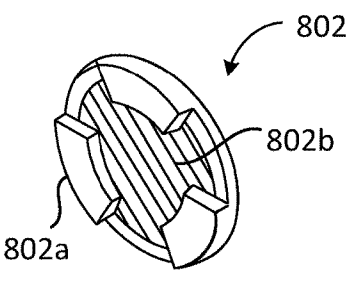

FIGS. 8A, 8B and 8C are diagrams that illustrate, respectively, a cross-sectional view, a plan view and a perspective view of an attachment assembly 802, which is similar to the attachment assembly 402, that includes a magnetic element 802*b* and retention features 802*a* that are raised features that only extend partially around an outer perimeter of the magnetic element 802*b*, and can, in some implementations, cooperatively interface with like retention features disposed on, or included in another attachment assembly. As compared with the magnetic element 402*b* and retention features 402*a* of the attachment assembly 402, in the attachment assembly 802, the magnetic element 802*b* is disposed within an element that includes the retention features 802*a*. That is, in this example, the retention features 802*a* are monolithically integrated with an attachment element.

Figure 9A:
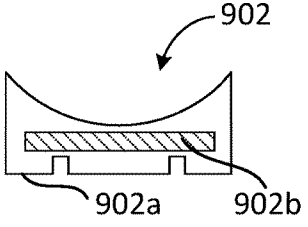
Figure 9B:
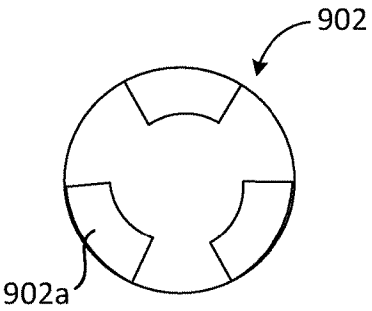
Figure 9C:
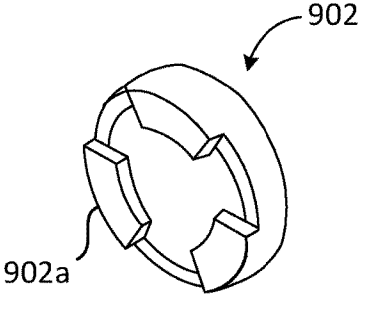

FIGS. 9A, 9B and 9C are diagrams that illustrate, respectively, a cross-sectional view, a plan view and a perspective view of an attachment assembly 902, similar to the attachment assembly 402 and the attachment assembly 802, that includes a magnetic element 902*b* and retention features 902*a* that are raised features that only extend partially around an outer perimeter of the magnetic element 902*b*, and can, in some implementations, cooperatively interface with like retention features disposed on another attachment assembly. As compared with the attachment assembly 402 and the attachment assembly 802, the magnetic element 902*b* of the attachment assembly 902 is embedded within an element that includes the retention features 902*a*, e.g., such that the magnetic element 902*b* is not exposed. As also shown in FIG. 9A, the integrated element including the retention features 902*a* includes a contoured surface, e.g., a top surface of the attachment assembly 902 in FIG. 9A, that can correspond with a contour of an attachment surface of an associated vessel body, e.g., an outer surface of the bottom end 101*b* of the vessel body 101.

Figure 10A:
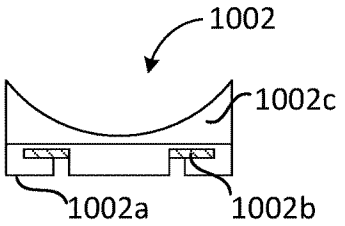
Figure 10B:
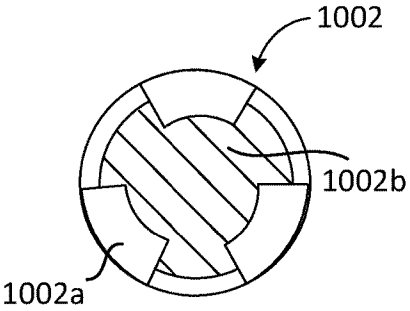
Figure 10C:
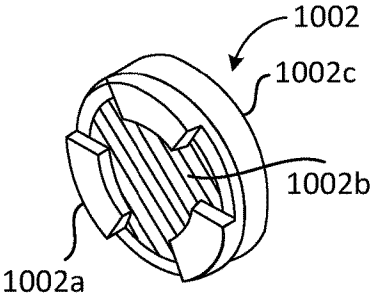

FIGS. 10A, 10B and 10C are diagrams that illustrate, respectively, a cross-sectional view, a plan view and a perspective view of an attachment assembly 1002, similar to the attachment assembly 402 and the attachment assembly 802, that includes a magnetic element 1002*b* and retention features 1002*a* that are raised features that only extend partially around an outer perimeter of the magnetic element 1002*b*, and can, in some implementations, cooperatively interface with like retention features disposed on another attachment assembly. As with the attachment assembly 802, the magnetic element 1002*b* of the attachment assembly 1002 is disposed within an element that includes the retention features 1002*a*. In comparison with the attachment assembly 802 the attachment assembly 1002 includes an attachment element 1002*c* that is coupled with the integrated element including the retention features 1002*a*. As shown in FIG. 10A, the attachment element 1002*c* includes a contoured surface, e.g., a top surface of the attachment assembly 1002 in FIG. 10A, that can correspond with a contour of an attachment surface of an associated vessel body, e.g., the vessel body 101.

FIGS. 11A-11D are diagrams illustrating various views of a collapsible vessel 1100, and components of the collapsible vessel 1100, which can be an implementation of the collapsible stemware vessel 100. The collapsible vessel 1100 includes a vessel body 1101 and a vessel base 1104. Depending on the particular implementation, the collapsible vessel 1100, and other vessels described herein, can be made from various materials, including glass, ceramic, plastic, metal, wood, etc. In some implementations, the vessel body 1101 can be made from a first material and the vessel base 1104 can be made from a second, different material.

Figure 11A:
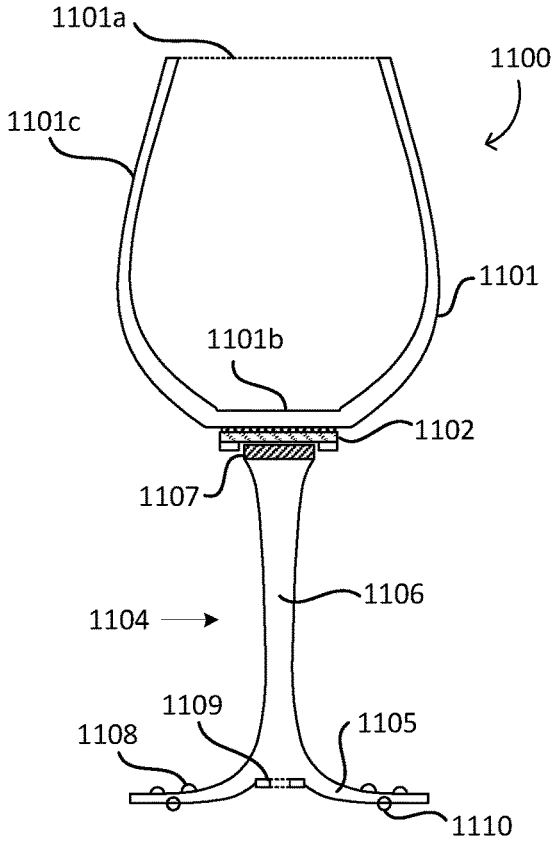
FIGS. 11A-11D are diagrams illustrating various views of a collapsible vessel, and components of the collapsible vessel.
Figure 11B:
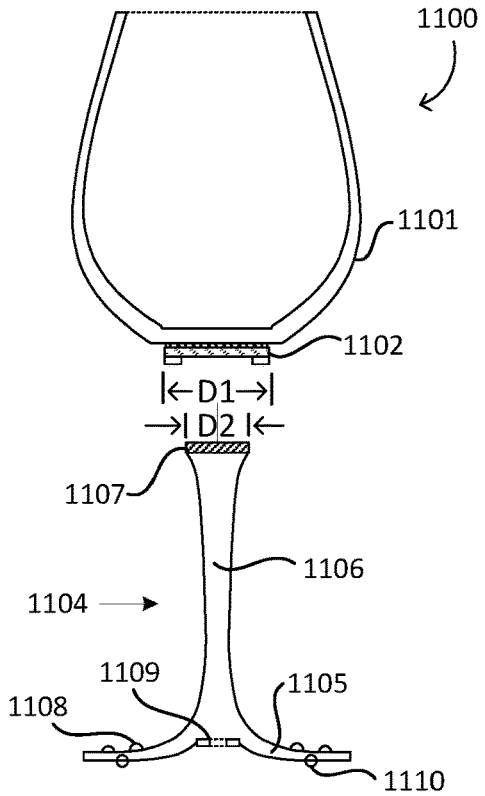
Figure 11C:
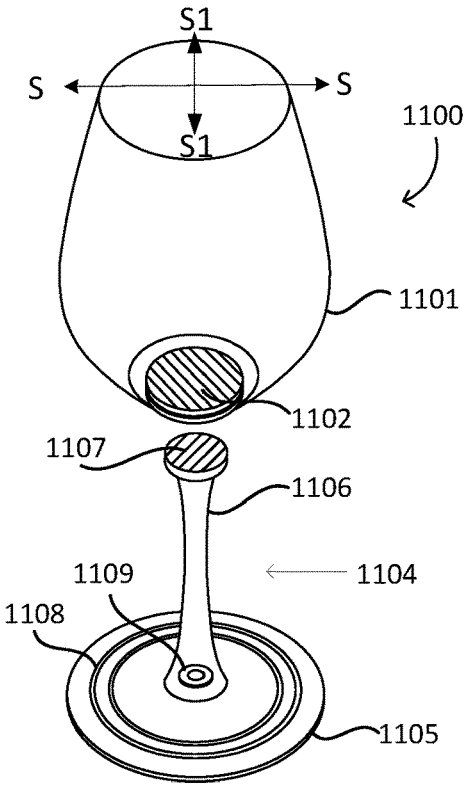
Figure 11D:
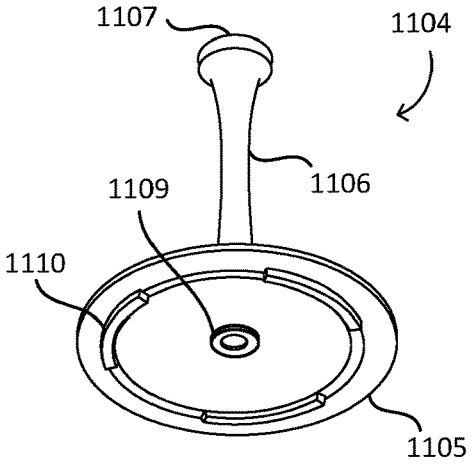

FIG. 11A is a diagram illustrating a cross-sectional view of the vessel body 1101 and the vessel base 1104 magnetically coupled with each attached together in a first configuration, e.g., for holding and/or consuming a liquid, or other substance. FIG. 11B is a diagram illustrating a cross-sectional view of the vessel body 1101 and the vessel base 1104 separated from each other. The cross-sectional views of the collapsible vessel 1100 in FIGS. 11A and 11B are taken along a plane defined by the lines S-S and S1-S1 in FIG. 11C. For purposes of this disclosure, the various cross-sectional views of collapsible vessels illustrated and described herein can be similarly taken along a plane as defined in FIG. 11C, and such plane is not shown for each example implementation. FIG. 11C is a diagram illustrating a perspective view of the collapsible vessel 1100, with the vessel base 1104 separated from the vessel body 1101, while FIG. 11D is a diagram illustrating a perspective view of the vessel base 1104, illustrating an underside of vessel base 1104, e.g., a bottom surface of a foot 1105 of the vessel base 1104.

Referring to FIGS. 11A-11D, similar to the vessel body 101 of the collapsible stemware vessel 100 in FIG. 1, the vessel body 1101 includes an open end 1101*a*, a closed end (a bottom end 1101*b*) and a side 1101*c*. The side 1101*c* can define a circumferential side surface of the vessel body 1101 and, in combination with the bottom end 1101*b*, can define an inner volume of the vessel body 1101. Also similar to the base 104 of the collapsible stemware vessel 100, the base 1104 can include a foot 1105, which can provide a generally planar support, or foundation for the collapsible stemware vessel 1100, which can generally be arranged in a plane. The base 1105 also includes a stem 1106 that is arranged orthogonal with the foot 1105.

As shown in FIG. 11A, the vessel body 1101 can be coupled, e.g., magnetically coupled, with the base 1104 via a first magnetic element 1102 that is disposed on the vessel body 1101, and a second magnetic element 1107 that is disposed on the stem 1106, of which one or both can be implemented as, or included in, respective attachment assemblies, such as those described herein.

As shown in FIG. 11B, the first magnetic element 1102 (of an attachment assembly) can have a width or diameter D1 that is wider than a width or diameter D2 of the second magnetic element 1107 included on the foot 1105. Such an arrangement can increase a magnetic connection strength, as compared to a connection between magnetic elements of a same width.

As shown in FIGS. 11A-11C, similar with the collapsible stemware vessel 100, the foot 1105, on its upper surface, includes alignment features 1108, which can be configured to prevent lateral movement of the vessel body 1101 relative to the base 1104 and/or the foot 1105 when the collapsible stemware vessel 1100 is arranged in a nested configuration. While the alignment features 1108 are shown as two raised circular features, defining a groove therebetween, in some implementations, the alignment features 1108 can include raised and/or recessed features, such as protrusions, grooves, etc., having different arrangements and/or configurations. As with the collapsible stemware vessel 100 shown in FIG. 1, the vessel body 1101, e.g., an opening of the open end 1101*a*, can have a width that is less than a width of the foot 1105. As noted above, such an arrangement can provide stability to the collapsible stemware vessel 1100 when in use, while the alignment features 1108 can provide stability when the collapsible stemware vessel 1100 is in a nested configuration.

In this example, the foot 1105 can have a magnetic element 1109 disposed on, coupled with, or embedded in a bottom side of the foot 1105, such as in an open space defined by the foot 1105. As discussed herein, the magnetic element 1109 can provide stability when stacking nested vessels, such as shown in, at least, FIGS. 14A-15D, and/or can facilitate attachment of ornamental elements with the foot 1105. As with the magnetic element 1102 and the magnetic element 1107, the magnetic element 1109 can include a magnet and/or a magnetically-attractive material.

As shown in FIGS. 11A-11D, the collapsible stemware vessel 1100 also includes alignment features 1110 disposed on a bottom side of the foot 1105, e.g., a side of the foot 1105 distal from, or opposite the stem 1106. In this example, the alignment features 1110 include a plurality of raised and recessed features arrange on the bottom surface of the foot 1105. However, depending on the implementation, the alignment features 1110 can also include different raised and/or recessed features, such as those examples illustrated in FIG. 29A-32C. Such alignment features, e.g., the alignment features 1110, can provide stability, alone or in combination with a magnetic element, e.g., the magnetic element 1109, for multiple vessels in a stacked configuration, such as shown in, at least, FIGS. 14A-15D.

Figure 12A:
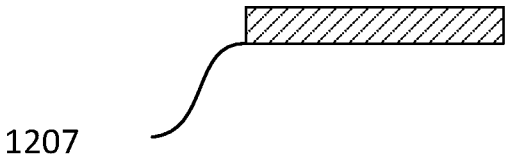
FIGS. 12A-12C are diagrams of a magnetic or magnetically attractive element that can be include in a collapsible vessel.
Figure 12B:
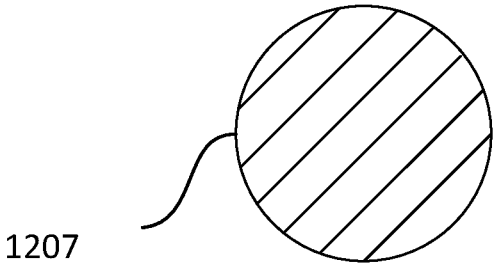
Figure 12C:
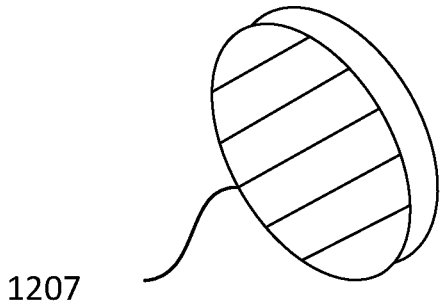

FIGS. 12A-12C are diagrams that illustrate, respectively, a cross-sectional view, a plan view and a perspective view of a magnetic element 1207 that, in some implementations, can be included in a stem of a collapsible vessel, such as the stem 106 of the collapsible stemware vessel 100, or the stem 1106 of the collapsible vessel 1100. As shown in the FIGS. 12A-12C, the magnetic element 1207 can take the form of a disk that is coupled or embedded in a vessel stem. In other implementations, the magnetic element 1207 can be included in an attachment assembly, such as those described herein.

Figure 13A:
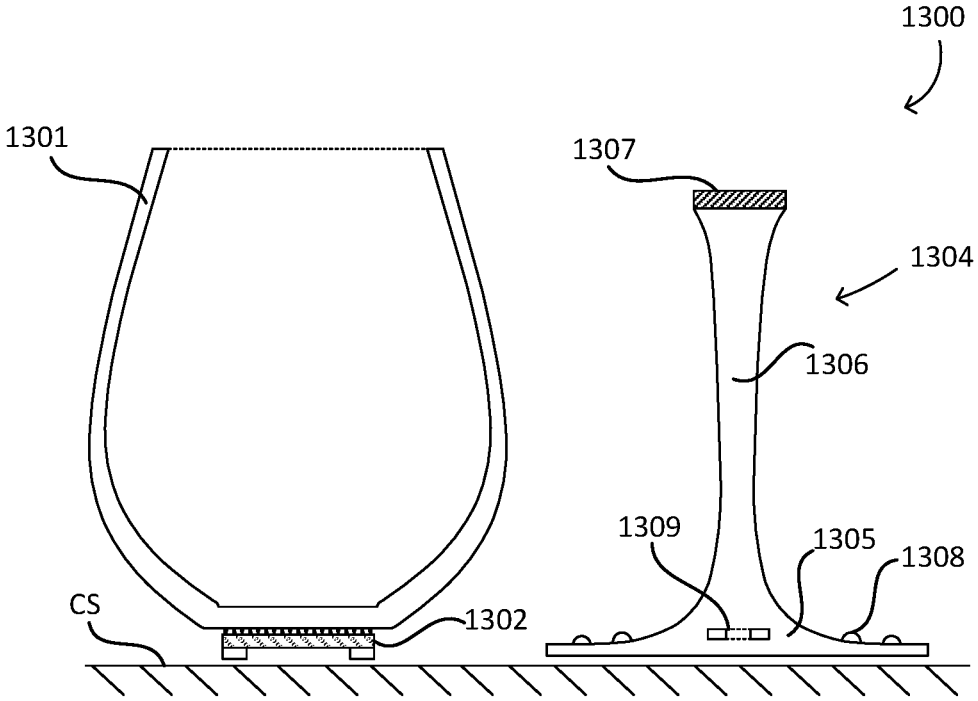
FIGS. 13A-13D are diagrams illustrating a collapsible vessel in various configurations.
Figure 13B:
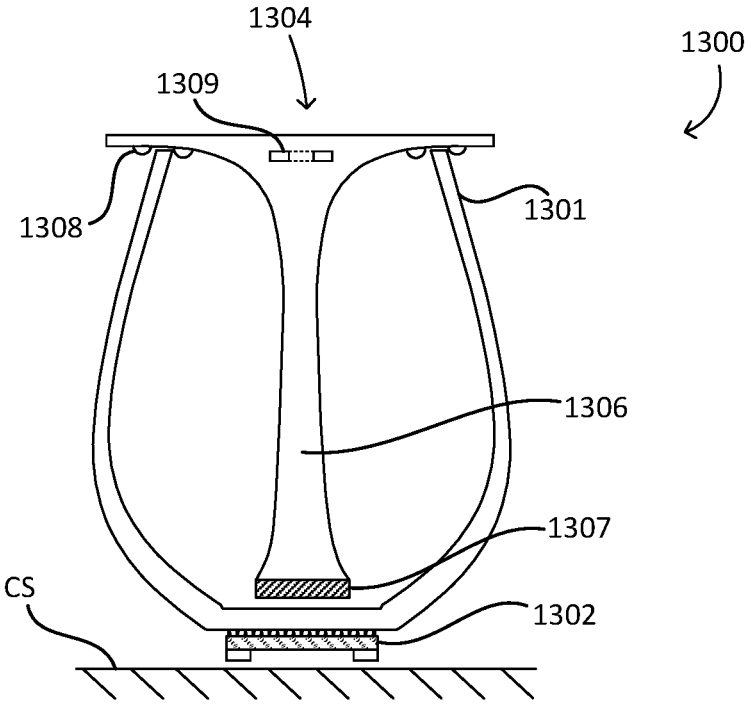
Figure 13C:
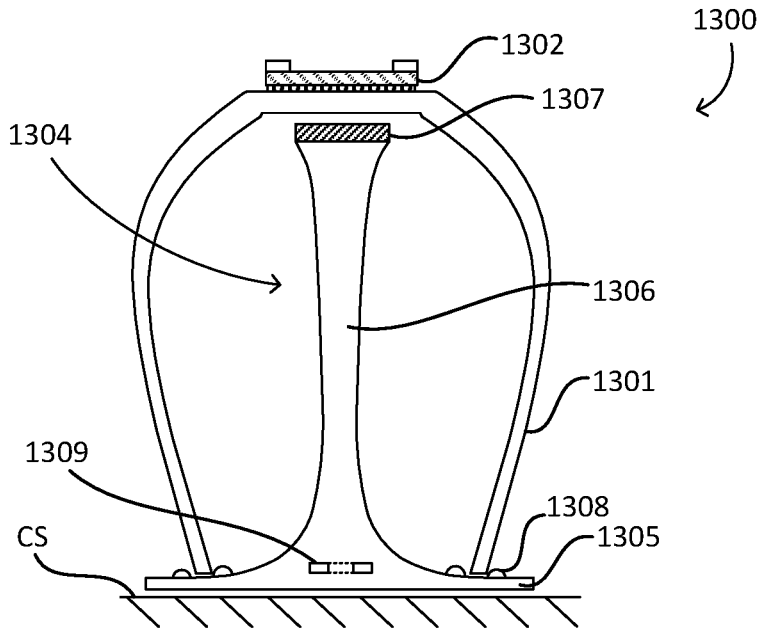
Figure 13D:
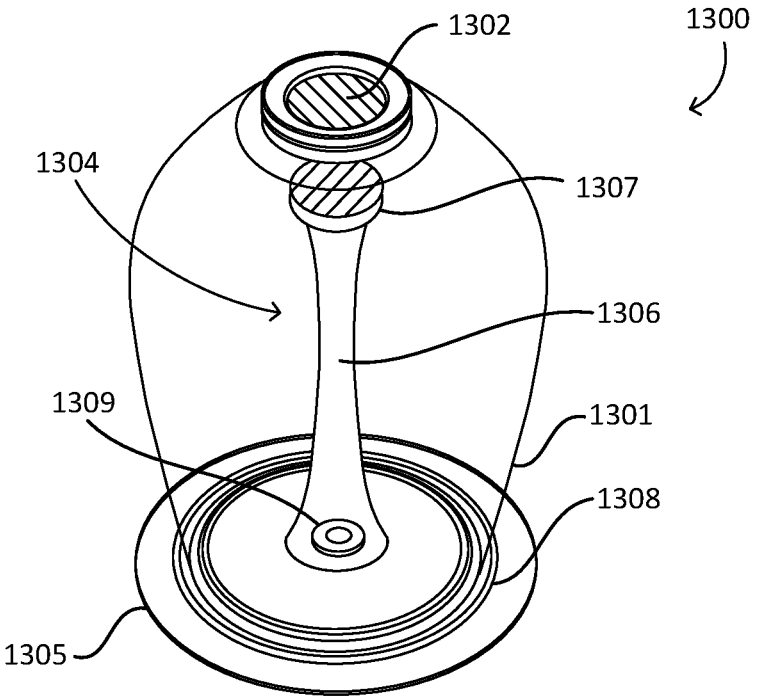

FIGS. 13A-13D are diagrams illustrating a collapsible vessel 1300 in various configurations. For instance, FIG. 13A is a diagram illustrating a cross-sectional view, e.g., along a plane such as the plane described with respect to FIG. 11C, of a body 1301 and a base 1304 of the collapsible vessel 1300, with each separately resting on a countersurface CS. FIG. 13B is a diagram illustrating a cross-sectional view of the body 1301 and the base 1304 resting on the countersurface CS in a nested configuration, where the nested collapsible vessel 1300 is resting on an attachment assembly 1302 coupled with the body 1301. FIG. 13C is a diagram illustrating a cross-sectional view of the body 1301 and the base 1304 resting on the countersurface CS in the nested configuration, where the nested collapsible vessel 1300 is resting on a foot 1305 of the base 1304. FIG. 13D is a diagram illustrating a perspective view of the collapsible vessel 1300 in the nested configuration.

As further shown in FIGS. 13A-13D, the base 1304 includes a stem 1306 and a foot 1305, which can be similarly arranged as the corresponding elements of collapsible stemware vessel 100 and/or the collapsible vessel 1100. The base 1304 also includes alignment features 1308 (e.g., disposed on an upper surface of the foot 1305), a magnetic element 1307 that can be disposed in, or on the stem 1306, and a magnetic element 1309 that is embedded in the foot 1305.

As shown in FIG. 13A, the attachment assembly 1302 can be configurated such that, when attached to the body 1301, the body 1301 and attachment assembly 1302 can be free standing on the countersurface CS, which can allow the body 1301 to be independently used as a vessel without the base 1304 attached. As shown in FIG. 13B, the stem 1306 can be inserted into the inner volume of the body 1301 to arrange the collapsible vessel 1300 in a nested configuration, e.g., for compact storage or transport. In such a configuration, magnetic attraction between the attachment assembly 1302, which can include a magnet or magnetically-attractive material, and the magnetic element 1307 can help retain, via axial, magnetic coupling, the body 1301 and the base 1304 together to prevent relative movement while in the nested configuration.

Depending on a length of a stem relative to a depth of a corresponding vessel body, when in a nested configuration, the stem can be inserted through the opening of the body, and be fully or partially housed within an inner volume of the body. That is, a length of the stem can be equal to, shorter than, or longer than an inner depth of the body, where the inner depth can be measured from an opening of the body to an inner bottom surface of the body. In implementations where the stem is longer than, equal to, or slightly less than the inner depth of the body, magnetic coupling can be achieved between magnetic elements included in the stem 1306, such as the magnetic element 1307, and the attachment assembly 1302.

Because the combination of the body 1301 and the attachment assembly 1302 is configured to be freestanding, the collapsible vessel 1300, in its nested configuration can be stored in the two different orientations, which are respectively shown in FIGS. 13B and 13C. For instance, as shown in FIG. 13B, the collapsible vessel 1300, in its nested configuration, can be stored with the attachment assembly 1302 resting on the countersurface CS. In contrast, as shown in FIG. 13C, the collapsible vessel 1300, in its nested configuration, can be stored with the foot 1305 of the base 1304 resting on the countersurface CS. Additionally, the ability to store collapsible vessels in different orientations can allow for them to be stored in stacked arrangements in alternating orientations, or in a same orientation, such as shown in the respective examples of FIGS. 14A-14D and FIGS. 15A-15D.

As illustrated in FIGS. 13B-13D, the alignment features 1308 can be incorporated into, formed on, or disposed on an upper surface of the foot 1305, where the foot 1305 contacts an opening of the body 1301 in a nested configuration of the collapsible vessel 1300. As described herein, the alignment features 1308 can provide lateral support to prevent the base 1304 and the body 1301 from sliding, or moving laterally, relative to each other in the nested configuration. In example implementations, the alignment features 1308 can include one or more continuous, raised and/or recessed features in the foot 1305. For instance, as shown in FIGS. 13B-13D, in the nested configuration of the collapsible vessel 1300, the alignment features 1308 can be disposed or arranged around an inner and/or an outer perimeter of an opening or lip of the body 1301. Additional examples of such alignment features are shown in, at least, FIGS. 17A-28C.

In some implementations, because the alignment features 1308 are configured to provide support against lateral sliding of the body 1301 relative to the base 1304 while in a nested configuration, with axial coupling provided by a magnetic connection, the alignment features 1308 can omit a snap or compression fit between the body 1301 and the foot 1305 of the base 1304. This can enable relatively wide tolerances to be used between the alignment features 1308 and an opening of the body 1301, and can also allow for use of inflexible materials, such as glass, for both the body 1301 and base 1304. It is noted that the arrangement of the various elements of the collapsible vessel 1300, such as arrangement of alignment features relative to a vessel body, nesting configurations, or separate freestanding body, can also apply to the other example implementations described herein.

As noted above, in some implementations, collapsible vessels, in their nested configurations, can be stacked one on top of another, e.g., for compact storage and/or transport. Further, as implementations of collapsible vessels, in their nested orientation, can be freestanding in different orientations, such as the orientations shown in FIGS. 13B and 13C, multiple nested vessels, in some implementations, can be stacked on top of each other in either a same orientation, or in alternating orientations. In some implementations, similar features can be used to stack vessels that are not collapsible, e.g., with a foot of one vessel resting on a foot of another vessel.

FIGS. 14A-14D are diagrams illustrating stacking of nested, collapsible vessels in alternating orientations, while FIGS. 15A-15D are diagrams illustrating stacking of nested, collapsible vessels in a same orientation. The collapsible vessels in the examples of FIGS. 14A-15D are similar to the collapsible vessel 1300, and can further include retention features disposed on a bottom surface a foot of a vessel base, such as retention features 1110 of the collapsible vessel 1100. As noted above, the cross-sectional views of FIGS. 14A-15D are taken along a plane that is consistent with the plane described with respect to FIG. 11C. While FIGS. 14A-14D and 15A-15D illustrated two and three vessels together, in some implementations, more than three vessels can be stacked using the example arrangements shown.

Figure 14B:
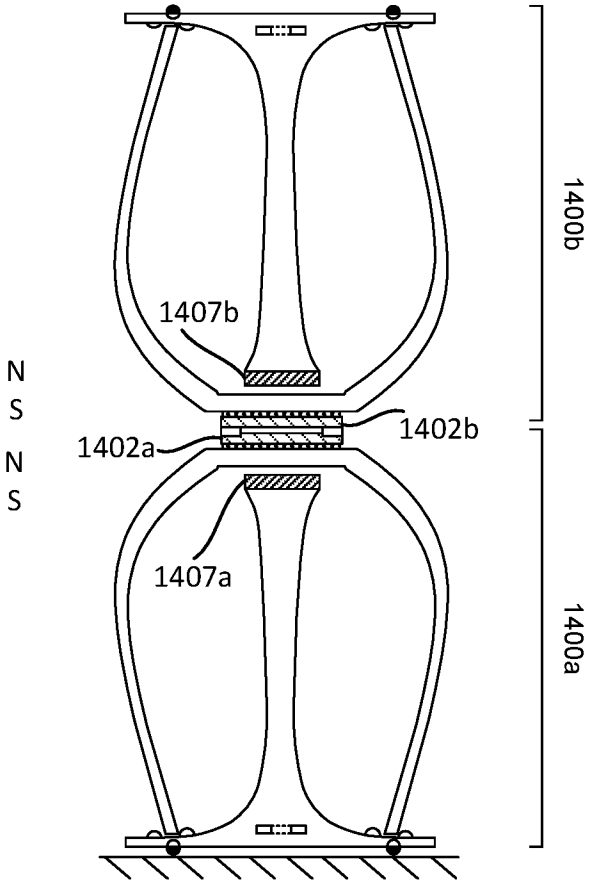
FIGS. 14A-14D are diagrams illustrating stacking of collapsible vessels in alternating orientations.
Figure 14A:
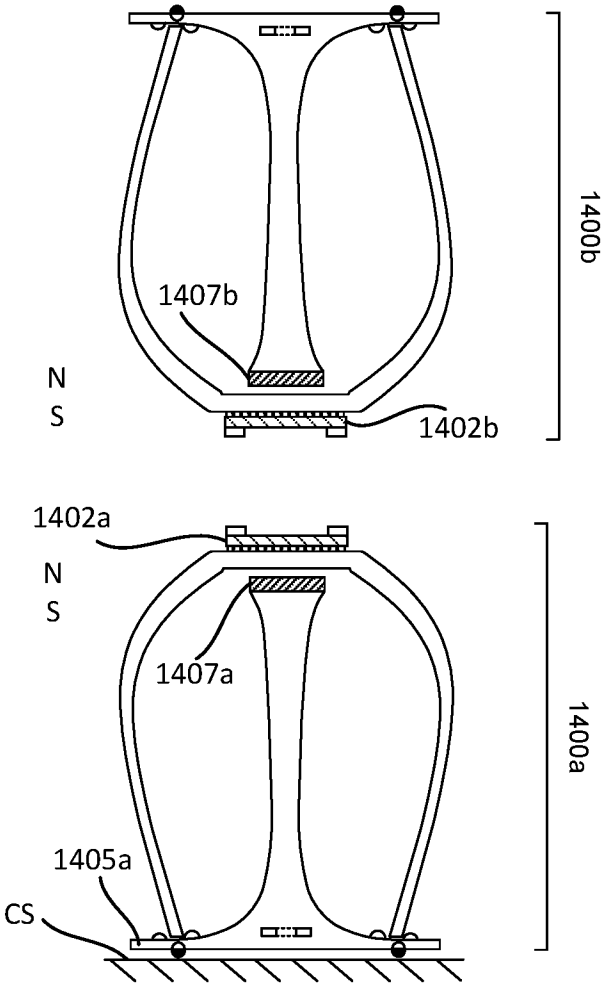
Figure 14D:
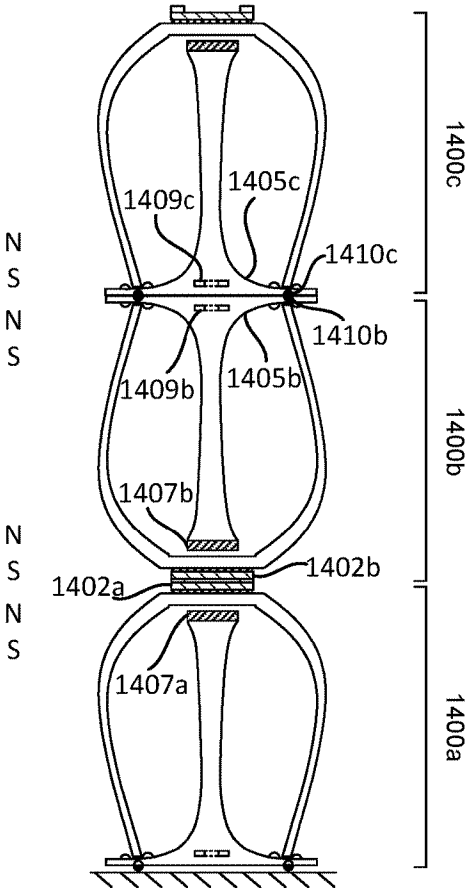
Figure 14C:
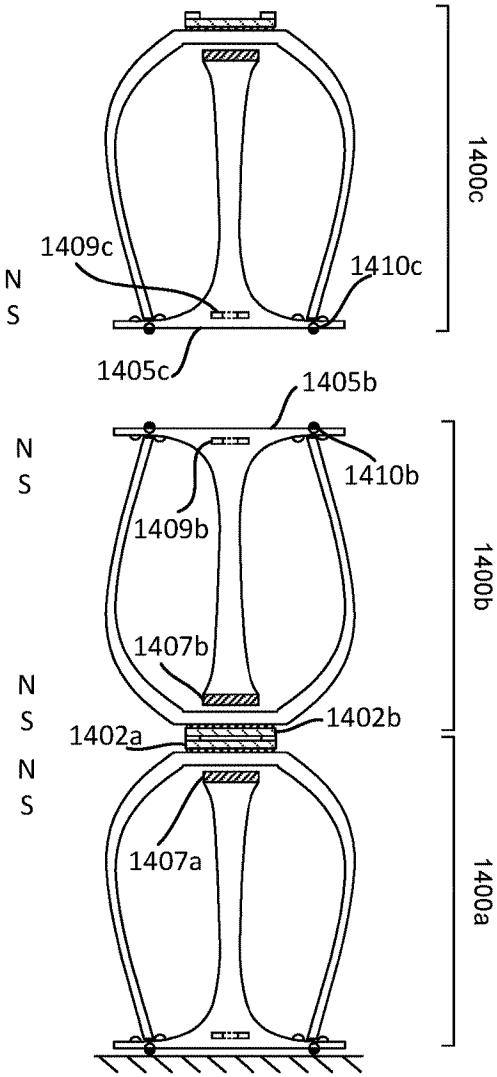

FIG. 14A, is a cross-sectional view of two collapsible, nested vessels in opposite orientations with the vessels separated. FIG. 14B is a cross-sectional view of the two collapsible, nested vessels in opposite orientations stacked on top of each other with magnetic coupling between the two nested vessels. FIG. 14C is a cross-sectional view of the two stacked vessels of FIG. 14B with a third collapsible, nested vessel in an alternating orientation than the upper vessel of FIG. 14B separated from the vessels of FIG. 14B. FIG. 14D is a cross-sectional view of the third vessel of FIG. 14C stacked on top of the second vessel in an alternating orientation, with further magnetic coupling between the second and third vessels.

Referring to FIG. 14A, a collapsible vessel 1400*a* and a collapsible vessel 1400*b*, in their nested configurations, are shown separated from each other. As shown in FIG. 14A, the vessel 1400*a* is disposed on a surface CS, with a foot 1405*a* of a base resting on the surface CS. The vessel 1400*b* is arranged in an opposite orientation as the vessel 1400*a*. The vessel 1400*a* includes a first magnetic element 1402*a*, e.g., an attachment assembly coupled with a body of the vessel 1400*a*, and a second magnetic element 1407*a*. Likewise, the collapsible vessel 1400*b* includes a first magnetic element 1402*b*, coupled with a body of vessel 1400*b*, and a second magnetic element 1407*b*.

In some implementations, such as in the example of FIGS. 14A-14D, and the example of FIGS. 15A-15D, only one of a magnetic element included in a vessel body, e.g., in an attachment assembly, and a magnetic element included in a vessel base, e.g., with a stem, or included in an attachment assembly coupled with a stem, can include a magnet or magnets, while the other includes a magnetically-attractive material. For instance, in such an approach, the second magnetic element 1407*a* of the vessel 1400*a* can include a magnet, and the first magnetic element 1402*a* can include a magnetically-attractive metal.

Such arrangements can allow for magnetic coupling between stacked, nested vessels without interference between magnet poles of same polarities. Example arrangements of such magnetic polarities (north (N) and south (S)) are shown in FIGS. 14A-15D. For instance, as shown in FIGS. 14A and 14B, a pole of a magnet included in the vessel 1400*a* (e.g., in either the first magnetic element 1402*a* or the second magnetic element 1407*a*) nearest the vessel 1400*b* can be of opposite polarity of a pole of a magnet included in the vessel 1400*b* (e.g., in either the first magnetic element 1402*b* or the second magnetic element 1407*b*) nearest the vessel 1400*b*.

In this example, the first magnetic element 1402*a* and the first magnetic element 1402*b* can include cooperative retention features, such as those described herein. That is, such cooperative retention features can be configured with geometries such that they interlock, interfere, and/or intermesh with each other to prevent lateral, or rotational movement of the vessel 1400*a* and the vessel 1400*b* relative to one another in the stacked arrangement of FIG. 14B.

FIGS. 14C and 14B show a third collapsible, nested vessel 1400*c* that is separated from the stacked vessels 1400*a* and 1400*b* in FIG. 14C, and stacked on top of the arrangement of the vessels 1400*a* and 1400*b* in FIG. 14D. In this example, the vessel 1400*c* is in an opposite orientation than that of the vessel 1400*b*, with the vessel 1400*a*, vessel 1400*b* and the vessel 1400*c* being stacked with alternating arrangements. That is, in the example of FIG. 14D, a foot 1405*c* of the vessel 1400*c* rests on top of a foot 1405*b* of the vessel 1400*b*. In this example, a magnet 1409*b* can be included in the foot 1405*b*, while a magnet 1409*c* can be included in the foot 1405*c*, where facing poles of the magnets 1409*b* and 1409*c* are of opposite polarity, such as shown in FIGS. 14C and 14D. In this arrangement, magnetic attraction between the magnet 1409*b* and the magnet 1409*c* provides an axial force to help hold the vessel 1400*b* and the vessel 1400*c* together in their stacked configuration. In some implementations, other arrangements of magnets and/or magnetically attractive elements are possible.

In the example of FIGS. 14A-14C, the foot 1405*b* and the foot 1405*c* can include, respectively, retention features 1410*b* and retention features 1410*c*, which can be similarly included in the foot 1405*a* of the vessel 1400*a*. As discussed herein the retention features 1410*b* and the retention features 1410*c* can include complimentary raised and/or recessed features that intermesh, interfere, or lock together to provide lateral support and help prevent the vessel 1400*b* and the vessel 1400*c* from sliding laterally, or rotating with respect to each other when in a stacked arrangement, shown in FIG. 14D. Examples of such retention features are shown, at least, in FIGS. 29A-30C. Depending on the particular implementation, the retention features, e.g., retention features 1410*b* and retention features 1410*c*, can be of various geometries, shapes, and number to provide lateral or rotational restraint of two bases relative to one another when the bottom surfaces of feet of those said bases are placed together.

Figure 15D:
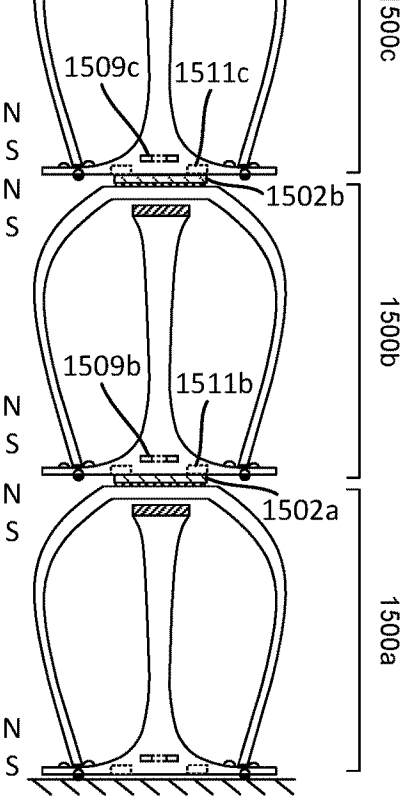
FIGS. 15A-15D are diagrams illustrating stacking of collapsible vessels in a same orientation.
Figure 15C:
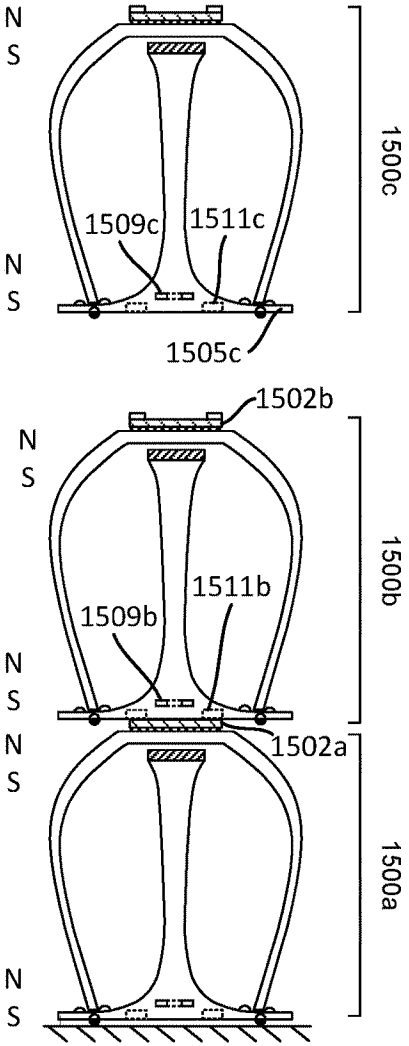
Figure 15B:
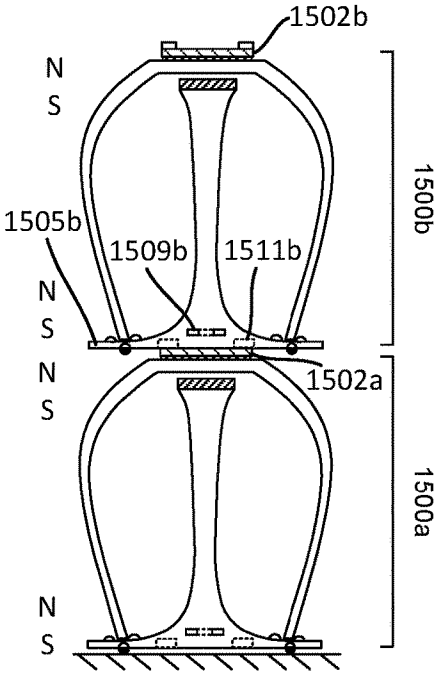
Figure 15A:
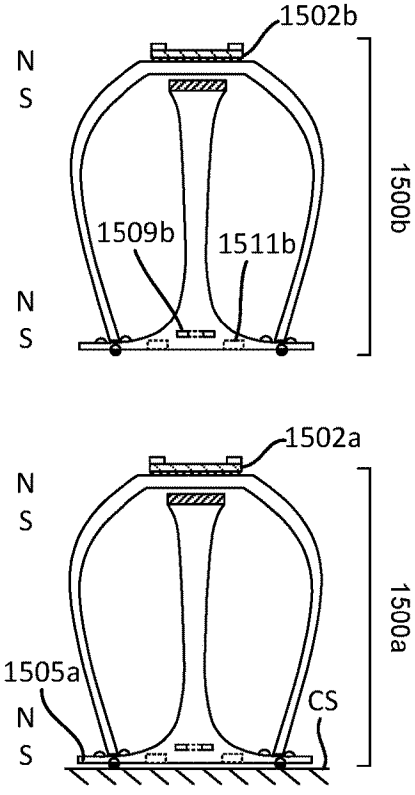

FIG. 15A, is a cross-sectional view of two collapsible, nested vessels in a same orientation with the vessels separated. FIG. 15B is a cross-sectional view of the two collapsible, nested vessels of FIG. 15A stacked on top of each other with magnetic coupling between the two nested vessels. FIG. 15C is a cross-sectional view of the two stacked vessels of FIG. 15B with a third collapsible, nested vessel in the same orientation, separated from the upper vessel of FIG. 15B. FIG. 15D is a cross-sectional view of the third vessel stacked on top of the second vessel, with further magnetic coupling between the second and third vessels.

Referring to FIG. 15A, a vessel 1500*a* and a vessel 1500*b*, in their nested configurations, are shown separated from each other. As shown in FIG. 15A, the vessel 1500*a* is disposed on a surface CS, with a foot 1505*a* of a base resting on the surface CS. The vessel 1500*b* is arranged in a same orientation as the vessel 1500*a*. The vessel 1500*a* includes a magnetic element 1502*a* coupled with a body of vessel 1500*a*, while the vessel 1500*b* includes a magnetic element 1509*b* included in a foot 1505*b* of the collapsible vessel 1500*b*. As shown in FIGS. 15A-15D, the magnetic element 1502*a* and the magnetic element 1509*b*, in the illustrated arrangement, can include magnets having poles of opposite magnetic polarity facing each other. In some implementations, magnets could be included in stems of the vessels shown in FIGS. 15A-15D, rather than in the magnetic elements coupled with the vessel bodies.

As shown in FIG. 15B, the vessel 1500*b* is stacked on the vessel 1500*a*, with the foot 1505*b* disposed on the magnetic element 1502*a*. In this arrangement, the magnetic element 1502*a* and the magnetic element 1509*b* can magnetically couple the vessel 1500*b* with the vessel 1500*a* to help retain the vessels in their stacked configuration. In this example, the foot 1505*b* can include retention features 1511*b*, e.g., raised or recessed features, that are cooperative with retention features include on the magnetic element 1502*a*. That is, the retention features 1511*b* can intermesh, interlock and/or surround retention features of the magnetic element 1502*a*, which can help prevent the vessel 1500*a* and the vessel 1500*b* from sliding laterally, or rotating relative to each other when in a stacked arrangement, such as shown in FIG. 15B.

Further to the arrangement of FIGS. 15A and 15B, FIGS. 15C and 15D illustrate a third vessel 1500*c* that is separated from the other two vessels in FIG. 15C, and stacked on the vessel 1500*b* in FIG. 15D. In this example, the vessel 1500*c* can include a magnetic element 1509*c* in a foot 1505*c*, and the foot 1505*c* can be disposed on, or stacked on a magnetic element 1502*b* of the vessel 1500*b*. In this arrangement, the magnetic element 1502*b* and the magnetic element 1509*c* can magnetically couple the vessel 1500*c* with the vessel 1500*b* to help retain the vessels in their stacked configuration. In this example, the foot 1505*c* can include retention features 1511, e.g., raised or recessed features, that are cooperative with retention features include on the magnetic element 1502*b*. That is, the retention features 1511*c* can intermesh, interlock and/or surround retention features of the magnetic element 1502*b*, which can help prevent the vessel 1500*b* and the vessel 1500*c* from sliding laterally, or rotating relative to each other when in a stacked arrangement, such as shown in FIG. 15D. The retention features 1511*b* and 1511*c* can include raised and/or recessed features of various geometries, shapes, and number to provide lateral or rotational movement restraint of stacked vessels.

FIGS. 16A-16G, 17A-17G and 18A-18G are diagrams illustrating respective magnetic attachment assemblies that can be included in a collapsible vessel. FIGS. 16A, 17A and 18A illustrate respective magnetic assemblies implemented on a collapsible vessel that is similar to the collapsible vessel 1100, and is shown by way of example. In some implementations, collapsible vessels having other configurations can be used in conjunction with the example magnetic attachment assemblies.

Figure 16B:
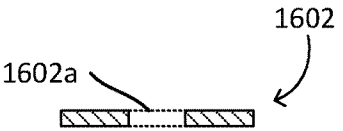
Figure 16C:
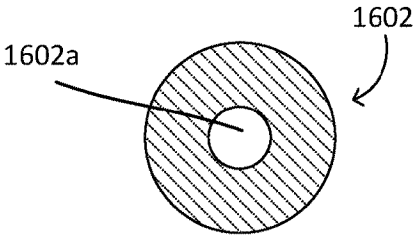
Figure 16D:
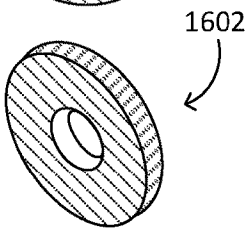
Figure 16E:
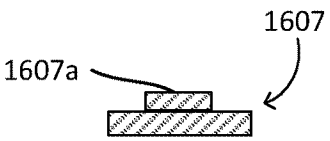
Figure 16F:
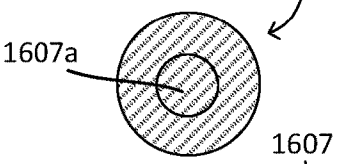
Figure 16G:
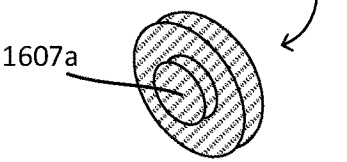
Figure 16A:
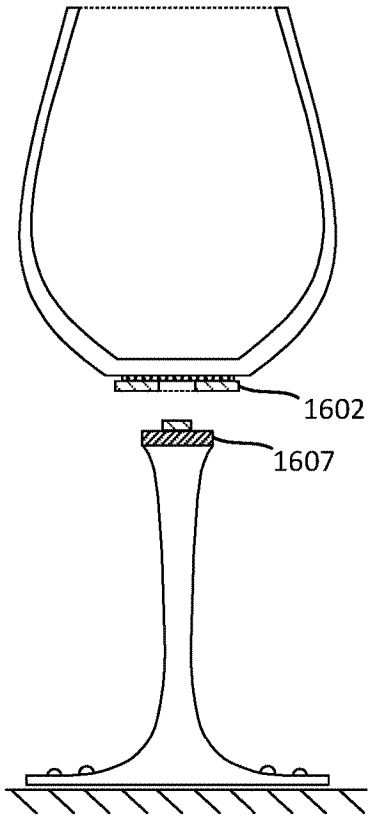
Figure 17A:
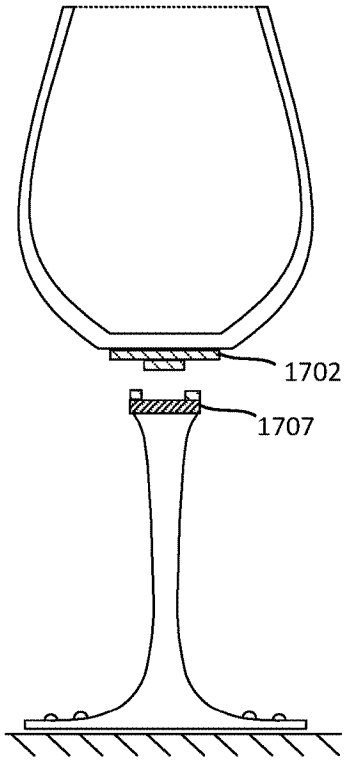

Referring to FIGS. 16A-16G, a magnetic assembly is illustrated that includes a magnetic element 1602, which can be coupled to a body of the collapsible vessel. The magnetic attachment assembly of FIGS. 16A-16G also includes a magnetic element 1607, which can be coupled with, or included in a stem of a base of the collapsible vessel. FIGS. 16B-16D illustrate, respectively, a cross-sectional view, a plan view, and a perspective view of the magnetic element 1602. As shown in FIGS. 16B-16D, the magnetic element 1602 can include an aperture 1602*a*. FIGS. 16E-16G illustrate, respectively, a cross-sectional view, a plan view, and a perspective view of the magnetic element 1607. As shown in FIGS. 16E-16G, the magnetic element 1607 can include a protrusion 1607*a* that can be configured to fit within the aperture 1602*a*, where the aperture 1602*a* and the protrusion 1607*a* can cooperatively act as retention features for the magnetic attachment assembly of FIGS. 16A-16G.

Figure 17B:
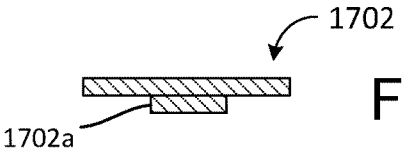
Figure 17C:
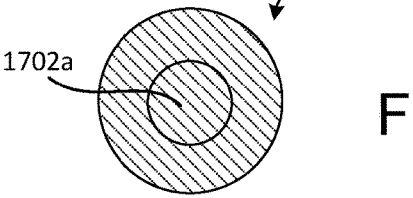
Figure 17D:
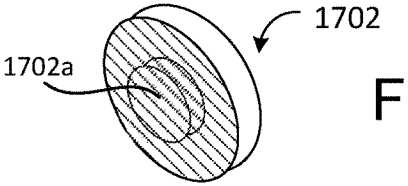
Figure 17E:
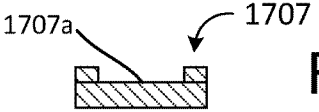
Figure 17F:
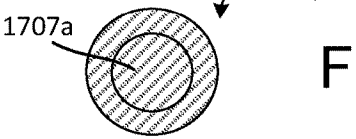
Figure 17G:
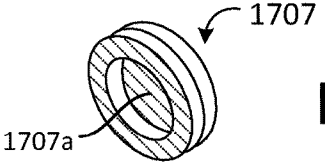

Referring to FIGS. 17A-17G, a magnetic assembly is illustrated that includes a magnetic element 1702, which can be coupled to a body of the collapsible vessel. The magnetic attachment assembly of FIGS. 17A-17G also includes a magnetic element 1707, which can be coupled with, or included in a stem of a base of the collapsible vessel. FIGS. 17B-17D illustrate, respectively, a cross-sectional view, a plan view, and a perspective view of the magnetic element 1702. As shown in FIGS. 17B-17D, the magnetic element 1702 can include a protrusion 1702*a*. FIGS. 17E-17G illustrate, respectively, a cross-sectional view, a plan view, and a perspective view of the magnetic element 1707. As shown in FIGS. 17E-17G, the magnetic element 1707 can include a recess 1707*a* that can be configured to fit over the protrusion 1702*a*, where the protrusion 1702*a* and the recess 1707*a* can cooperatively act as retention features for the magnetic attachment assembly of FIGS. 17A-17G.

Referring to FIGS. 18A-18G, a magnetic assembly is illustrated that includes a magnetic element 1802, which can be coupled to a body of the collapsible vessel. The magnetic attachment assembly of FIGS. 18A-18G also includes a magnetic element 1807, which can be coupled with, or included in a stem of a base of the collapsible vessel. FIGS. 18B-18D illustrate, respectively, a cross-sectional view, a plan view, and a perspective view of the magnetic element 1802. As shown in FIGS. 18B-18D, the magnetic element 1802 can include a recess 1802*a*. FIGS. 18E-18G illustrate, respectively, a cross-sectional view, a plan view, and a perspective view of the magnetic element 1807. As shown in FIGS. 18E-18G, the magnetic element 1807 can include a raised ring 1807*a* that can be configured to fit in the recess 1802*a*, where the recess 1802*a* and the raised ring 1807*a* can cooperatively act as retention features for the magnetic attachment assembly of FIGS. 18A-18G. It is noted that, while magnetic attachment assemblies described herein, such the examples of FIGS. 2A-10C and 16A-18C are generally described as having circular geometries, in some implementations, magnetic attachment assemblies having other shapes can be used, such a rectangular or other geometries.

Figure 20:
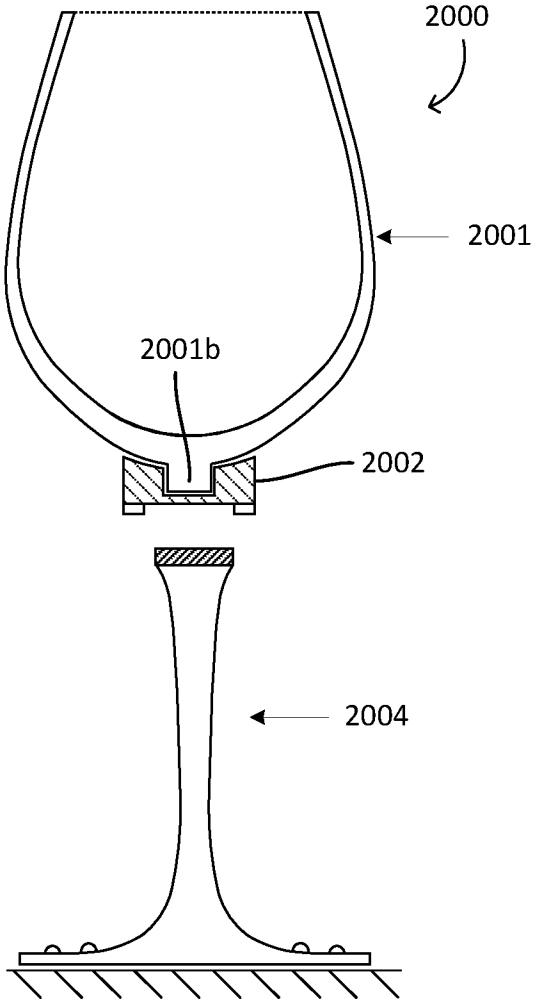
FIG. 20 is a diagram illustrating a collapsible vessel and corresponding magnetic attachment assembly.
Figure 19:
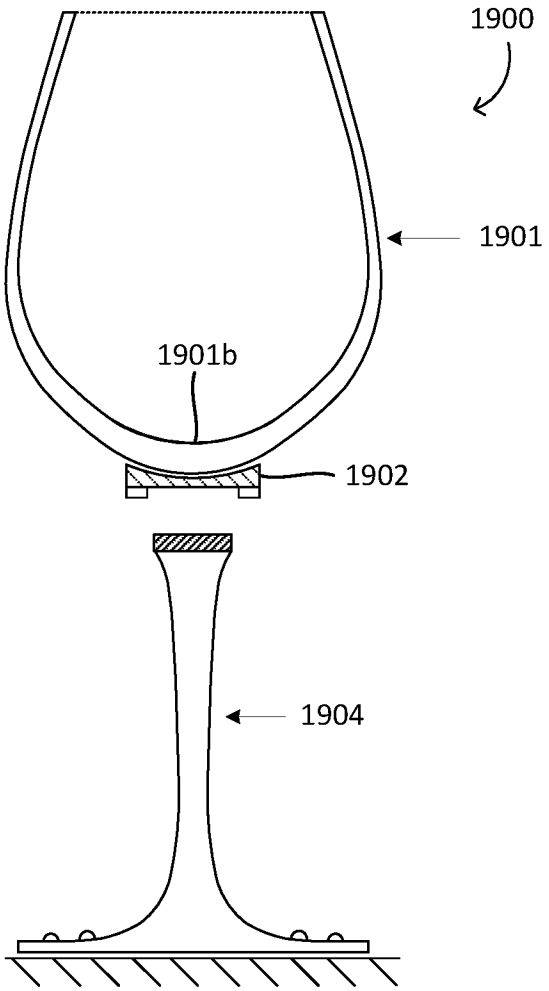
FIG. 19 is a diagram illustrating a collapsible vessel and corresponding magnetic attachment assembly.

FIGS. 19 and 20 are diagrams illustrating collapsible vessels and corresponding magnetic attachment assemblies that conform to a shape of an attachment surface of a body of their respective vessels. For instance, FIG. 19 is a diagram that illustrates a collapsible vessel 1900 including a body 1901, an attachment assembly 1902, e.g., including a magnetic element, and a base 1904, which can include another magnetic element at an upper end of a stem of the base 1904. As shown in FIG. 19, the attachment assembly 1902 is coupled with the body 1901 and configured to match a contour of an outer surface of a closed end 1901*b* of the body 1901, which is, in this example, is a curved surface. FIG. 20 is a diagram that illustrates a collapsible vessel 2000 including a body 2001, an attachment assembly 2002, e.g., including a magnetic element, and a base 2004, which can include another magnetic element at an upper end of a stem of the base 2004. As shown in FIG. 20, the attachment assembly 2002 is coupled with the body 2001 and configured to match a shape of an outer surface of a closed end of the body 2001, which, in this example, includes a protrusion 2001*b*.

Figure 21B:
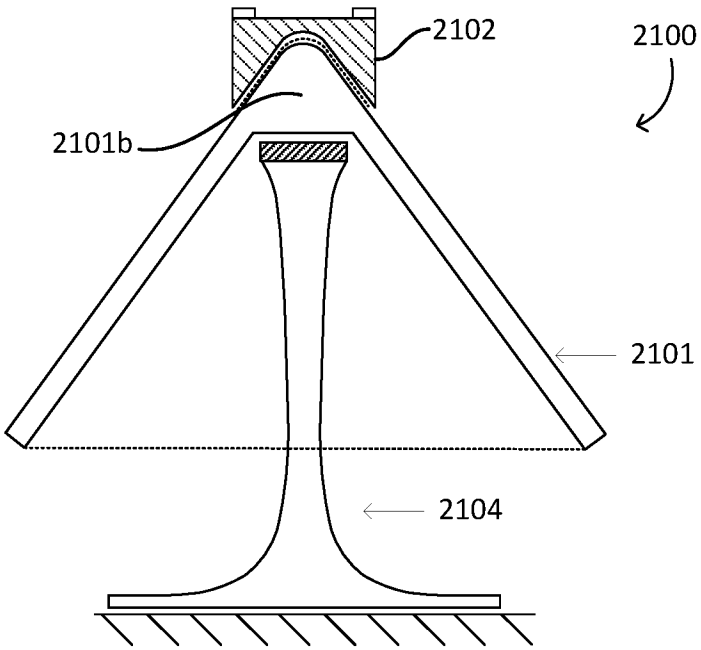
FIGS. 21A and 21B are diagrams illustrating a collapsible vessel and corresponding magnetic attachment assembly.
Figure 21A:
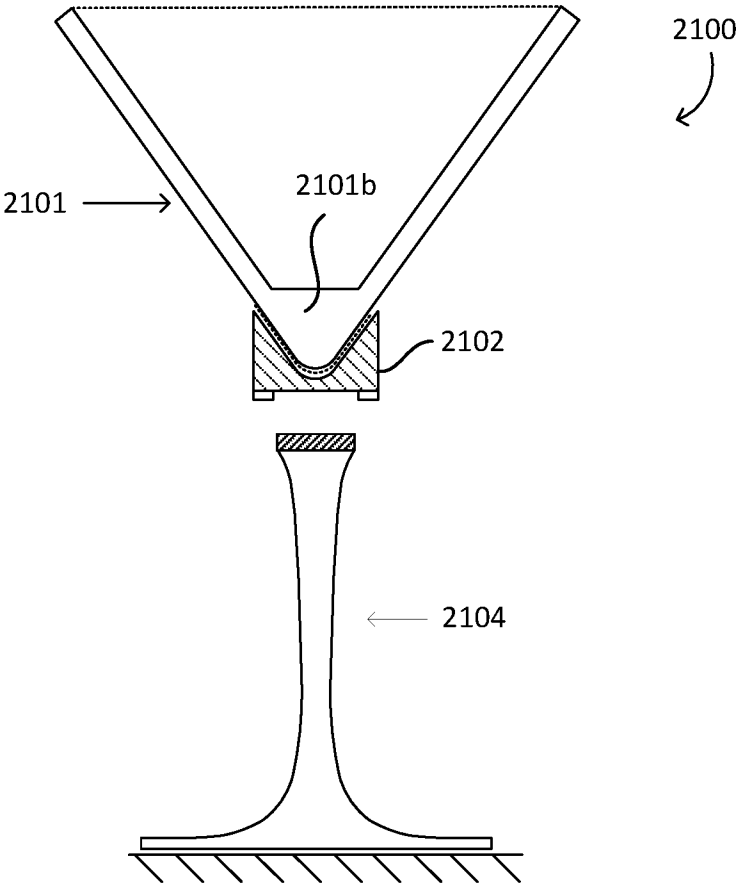

FIGS. 21A and 21B are diagrams illustrating a collapsible vessel 2100 including a magnetic attachment assembly. As shown in FIG. 21A, the collapsible vessel 2100 includes a body 2101. e.g., a conical shaped, martini glass body, an attachment assembly 2102 (e.g., including a magnetic element), and a base 2104, which can include another magnetic element at an upper end of a stem of the base 2104. As shown in FIGS. 21A and 21B, the attachment assembly 2102 is coupled with the body 2101 and configured to match a shape of an outer surface of a closed end 2101*b* of the body 2101, which, in this example, is conical. FIG. 21B illustrates the collapsible vessel 2100 in a nested configuration. In this example, a stem of the base 2104 has a length that is longer than an inner depth of the body 2101. Accordingly, in the nested configuration shown in FIG. 21B, the stem of the base 2104 is only partially disposed with an inner volume of the 2101, and an end of the stem in contact with inner surface of the closed end 2101*b* of the body 2101. Similar to other collapsible vessels implementations described herein, the body 2101 and attachment assembly 2102 be configured to be freestanding when not attached to base 2104, which can allow the body 2101 to be used for holding, dispensing, and/or consuming liquids or other substances when not attached to the base 2104.

FIGS. 22A-22C, 23A-23C, 24A-24C, 25A-25C, 26A-26C, 27A-27C and 28A-28C are diagrams illustrating various views of respective collapsible vessels. The example implementations of FIGS. 22A-28C illustrate implementations of various alignment features that can, e.g., be included on, incorporated on, formed on, or formed in a foot of a base of their respective collapsible vessel. As shown in FIGS. 22A-28C, such alignment features can include raised and/or recessed features, e.g., incorporated into, in or on an upper surface of a vessel base. In such implementations, the base can contact a vessel body, such as an opening of the vessel body in a nested configuration. In the nested arrangement, the features can provide support, e.g., mechanical support, to prevent the base and body from sliding laterally relative to each other in their nested configuration.

In some implementations, such as the examples of FIGS. 22A-28C, such alignment features can be implemented as one, or multiple continuous or segmented features that can be arranged around an inner and/or an outer perimeter of an opening lip of a corresponding vessel body with the vessel in a nested configuration. The example implementations of FIGS. 22A-28C can include magnetic attachments assemblies, such as those described herein. However, for purposes of brevity and clarity, those magnetic attachments assemblies are not described with respect to the example implementations of FIGS. 22A-28C.

Figure 22A:
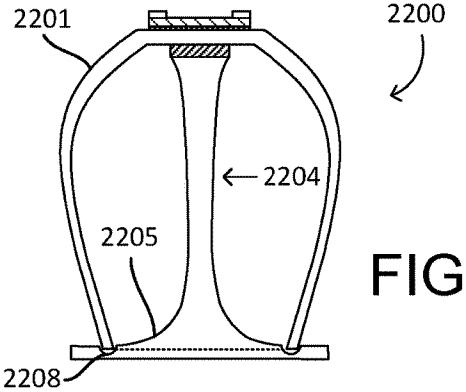
Figure 22B:
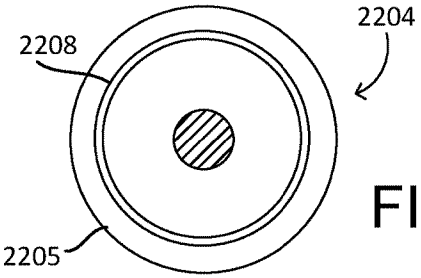
Figure 22C:
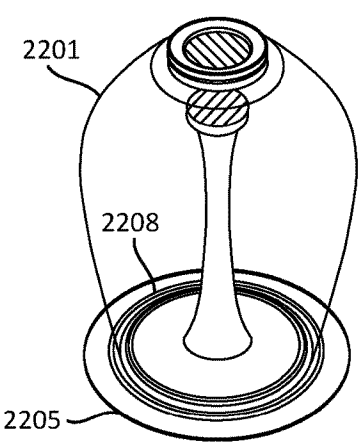

FIGS. 22A-22C are diagrams illustrating, respectively, a cross-sectional view of a collapsible vessel 2200 in a nested configuration, a plan view of a base 2204 of the collapsible vessel 2200, and a perspective view of the collapsible vessel 2200 in its nested configuration. As shown in FIGS. 22A-22C, the base 2204 can include a foot 2205. In this example, an alignment feature 2208, implemented as a continuous groove, can be incorporated in, or formed in, the foot 2205. As shown FIGS. 22A and 22C, in the nested configuration, a lip of a body 2201 of the collapsible vessel 2200 can rest in the alignment feature 2208.

Figure 23A:
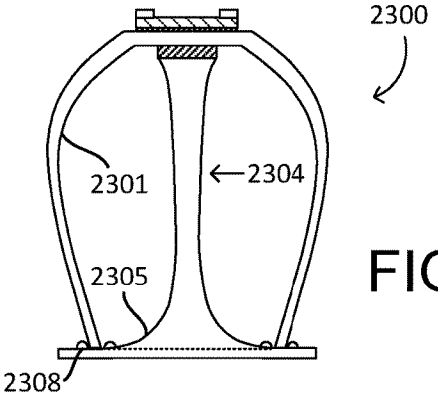
FIGS. 22A-22C, 23A-23C, 24A-24C, 25A-25C, 26A-26C, 27A-27C and 28A-28C are diagrams illustrating various views of respective collapsible vessels.
Figure 23B:
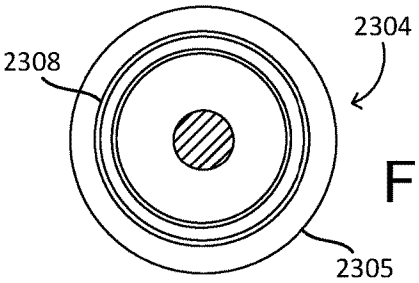
Figure 23C:
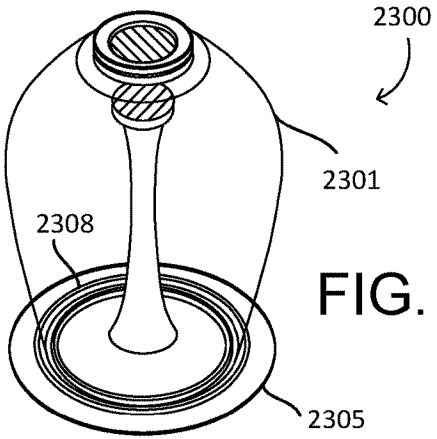

FIGS. 23A-23C are diagrams illustrating, respectively, a cross-sectional view of a collapsible vessel 2300 in a nested configuration, a plan view of a base 2304 of the collapsible vessel 2300, and a perspective view of the collapsible vessel 2300 in its nested configuration. As shown in FIGS. 23A-23C, the base 2304 can include a foot 2305. In this example, alignment features 2308, implemented as two raised, continuous circular features, can be incorporated in, or formed on the foot 2305. As shown FIGS. 23A and 23C, in the nested configuration, a lip of a body 2301 of the collapsible vessel 2300 can rest on an upper surface of the foot 2305, e.g., between the two alignment features 2308.

Figure 24A:
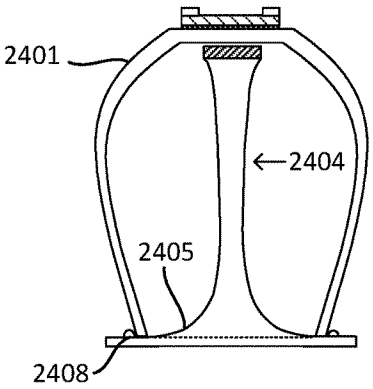
Figure 24B:
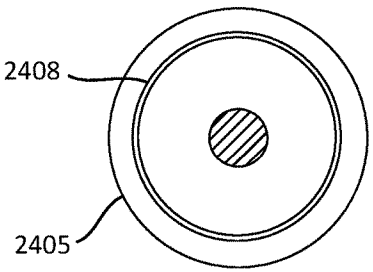
Figure 24C:
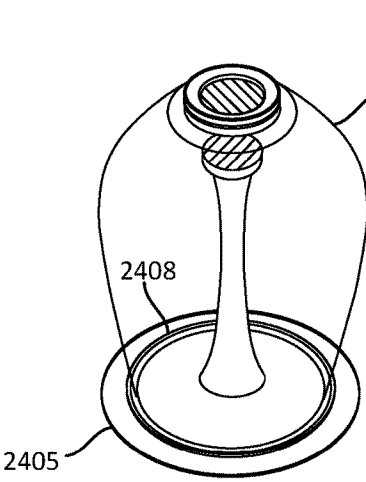

FIGS. 24A-24C are diagrams illustrating, respectively, a cross-sectional view of a collapsible vessel 2400 in a nested configuration, a plan view of a base 2404 of the collapsible vessel 2400, and a perspective view of the collapsible vessel 2400 in its nested configuration. As shown in FIGS. 24A-24C, the base 2404 can include a foot 2405. In this example, an alignment feature 2408, implemented as a single raised, continuous circular feature, can be incorporated in, or formed on the foot 2405. As shown FIGS. 24A and 24C, in the nested configuration, a lip of a body 2401 of the collapsible vessel 2400 can rest on an upper surface of the foot 2405, e.g., within an inner perimeter of the alignment feature 2408.

Figure 25A:
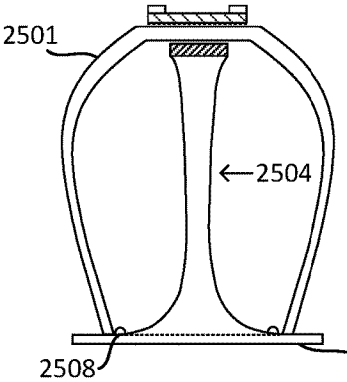
Figure 25B:
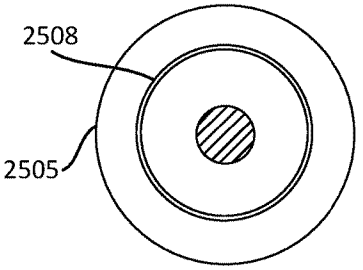
Figure 25C:
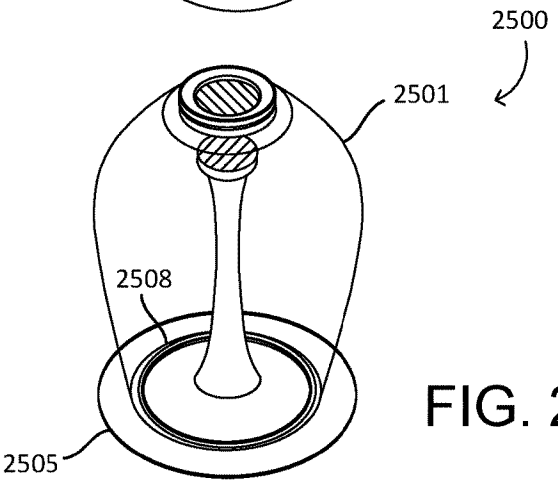

FIGS. 25A-25C are diagrams illustrating, respectively, a cross-sectional view of a collapsible vessel 2500 in a nested configuration, a plan view of a base 2504 of the collapsible vessel 2500, and a perspective view of the collapsible vessel 2500 in its nested configuration. As shown in FIGS. 25A-25C, the base 2504 can include a foot 2505. In this example, an alignment feature 2508, implemented as a single raised, continuous circular feature, can be incorporated in, or formed on the foot 2505. As shown FIGS. 25A and 25C, in the nested configuration, a lip of a body 2501 of the collapsible vessel 2500 can rest on an upper surface of the foot 2505, e.g., around an outer perimeter of the alignment feature 2508.

Figure 26A:
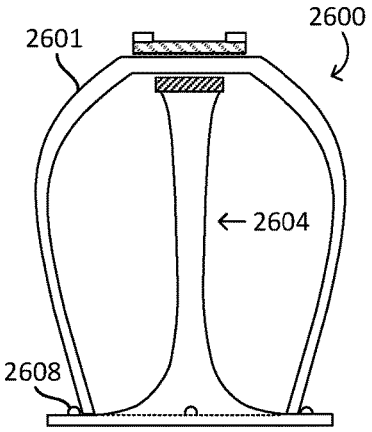
Figure 26B:
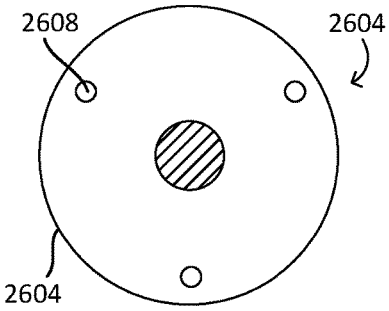
Figure 26C:
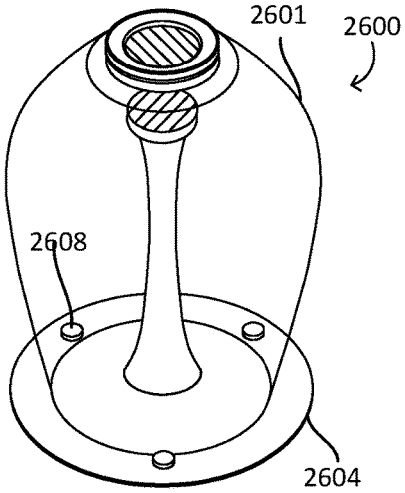

FIGS. 26A-26C are diagrams illustrating, respectively, a cross-sectional view of a collapsible vessel 2600 in a nested configuration, a plan view of a base 2604 of the collapsible vessel 2600, and a perspective view of the collapsible vessel 2600 in its nested configuration. As shown in FIGS. 26A-26C, the base 2604 can include a foot 2605. In this example, alignment feature 2608, implemented as a plurality of protrusions, can be incorporated in, or formed on the foot 2605. As shown FIGS. 26A and 26C, in the nested configuration, a lip of a body 2601 of the collapsible vessel 2600 can rest on an upper surface of the foot 2605, e.g., where the alignment features 2608 (protrusions) are distributed around an outer perimeter of the lip of the body 2601.

Figure 27A:
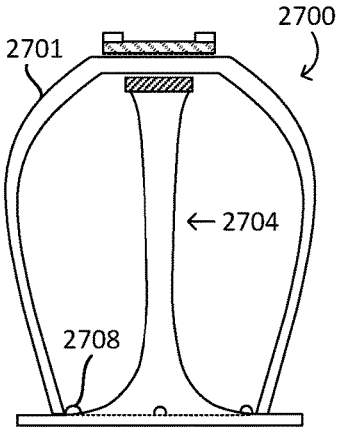
Figure 27B:
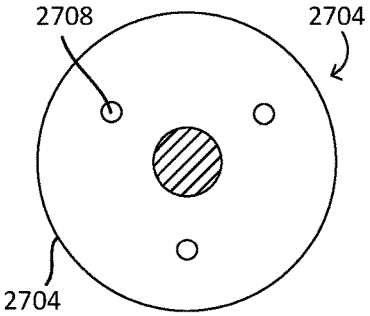
Figure 27C:
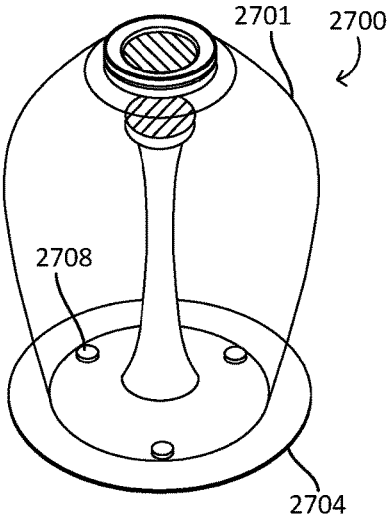

FIGS. 27A-27C are diagrams illustrating, respectively, a cross-sectional view of a collapsible vessel 2700 in a nested configuration, a plan view of a base 2704 of the collapsible vessel 2700, and a perspective view of the collapsible vessel 2700 in its nested configuration. As shown in FIGS. 27A-27C, the base 2704 can include a foot 2705. In this example, alignment feature 2708, implemented as a plurality of protrusions, can be incorporated in, or formed on the foot 2705. As shown FIGS. 27A and 27C, in the nested configuration, a lip of a body 2701 of the collapsible vessel 2700 can rest on an upper surface of the foot 2705, e.g., where the alignment features 2708 (protrusions) are distributed around an inner perimeter of the lip of the body 2701.

Figure 28A:
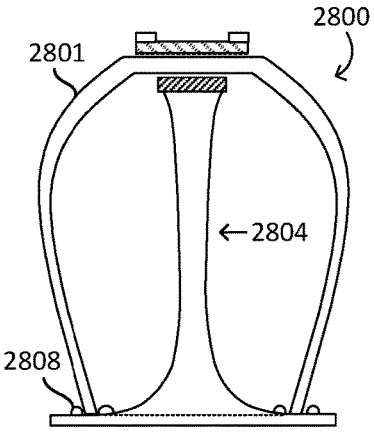
Figure 28B:
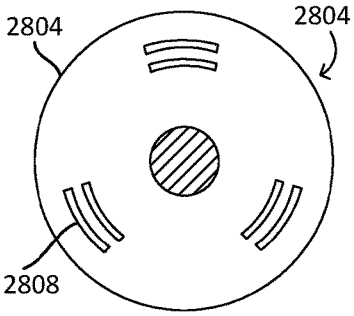
Figure 28C:
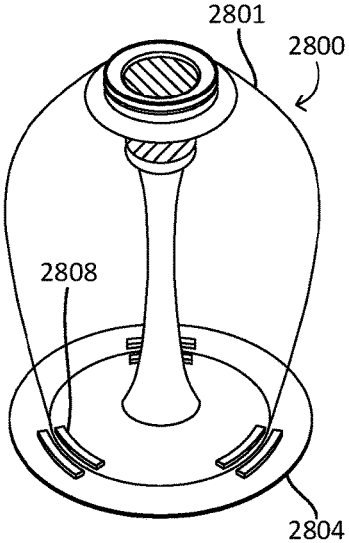

FIGS. 28A-28C are diagrams illustrating, respectively, a cross-sectional view of a collapsible vessel 2800 in a nested configuration, a plan view of a base 2804 of the collapsible vessel 2800, and a perspective view of the collapsible vessel 2800 in its nested configuration. As shown in FIGS. 28A-28C, the base 2804 can include a foot 2805. In this example, alignment features 2808, implemented as multiple raised, segmented circular features, can be incorporated in, or formed on the foot 2805. As shown FIGS. 28A and 28C, in the nested configuration, a lip of a body 2801 of the collapsible vessel 2800 can rest on an upper surface of the foot 2805, e.g., between the respective segments of the two, segmented circular alignment features 2808.

FIGS. 29A-29C, 30A-30C, 31A-31C and 32A-32C are diagrams illustrating various views of respective, collapsible vessel bases. The example implementations of FIGS. 29A-32C illustrate implementations of various retention features that can be included on, incorporated on, formed on, or formed in a foot of a base of their respective collapsible vessel, such as on a bottom surface of a foot of a vessel base. Such retention features can be configured to prevent lateral and/or rotational movement of one vessel respect to another vessel, when the vessels are stacked with each other, such as in the arrangements shown in FIGS. 14A-15D.

As shown in FIGS. 29A-32C, and noted above, such retention features can include raised and/or recessed features that are incorporated into, in or on, a bottom surface of a vessel base. In such implementations, the bottom surface of a foot including such retention features can contact a bottom surface of a foot of another vessel, or can contact an attachment assembly coupled with a vessel body of vessel arranged in a nested configuration. Retention features included on the bottom surface of the feet of the vessel bases, and or retention features included in an attachment assembly can interface, interfere or interlock to prevent lateral and/or rotational movement of one vessel with respect to another vessel with which it is stacked.

Figure 29A:
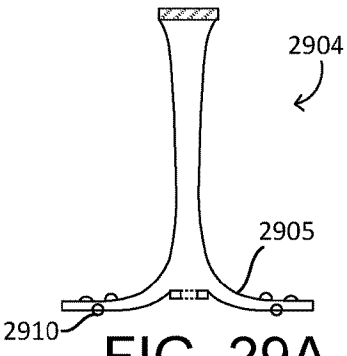
Figure 29B:
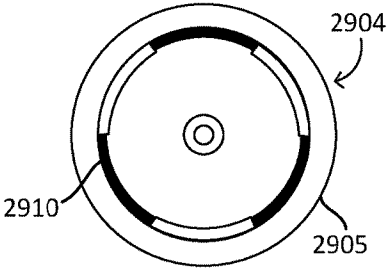
Figure 29C:
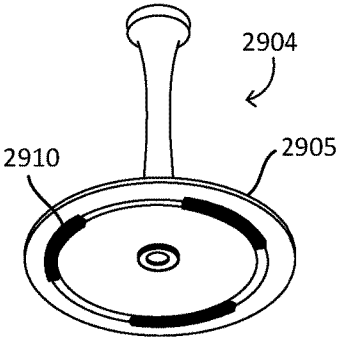

FIGS. 29A-29C are diagrams illustrating, respectively, a cross-sectional view, a plan view, and a perspective, underside view of a base 2904 of a collapsible vessel. As shown in FIGS. 29A-29C, the base 2904 can include a foot 2905. In this example, retention features 2910, implemented as alternating raised and recessed features in a circular arrangement, can be incorporated in, or formed on a bottom surface of the foot 2905. In a stacked arrangement, the foot 2905 can be placed in contact with a foot 2905 of a like vessel. The respective retention features 2910 of each foot 2905 can interface, interlock, and/or interfere with each other, e.g., to help prevent relative lateral and/or rotational movement of the vessels.

Figure 30A:
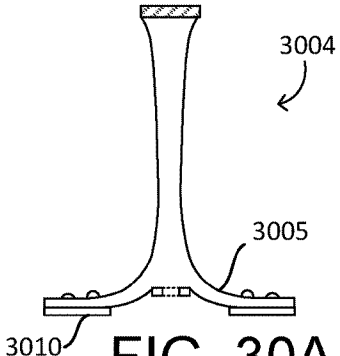
Figure 30B:
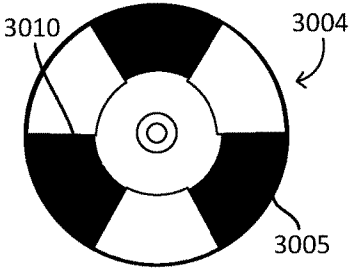
Figure 30C:
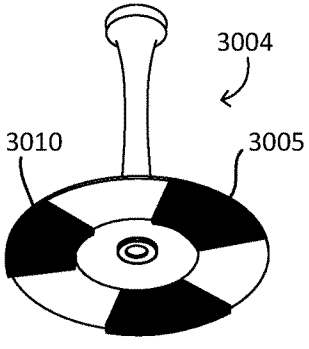

FIGS. 30A-30C are diagrams illustrating, respectively, a cross-sectional view, a plan view, and a perspective, underside view of a base 3004 of a collapsible vessel. As shown in FIGS. 30A-30C, the base 3004 can include a foot 3005. In this example, retention features 3010, implemented as alternating raised and recessed features in a circular arrangement, can be incorporated in, or formed on a bottom surface of the foot 3005. In a stacked arrangement, the foot 3005 can be placed in contact with a foot 3005 of a like vessel. The respective retention features 3010 of each foot 3005 can interface, interlock, and/or interfere with each other, e.g., to help prevent relative lateral and/or rotational movement of the vessels.

Figure 31A:
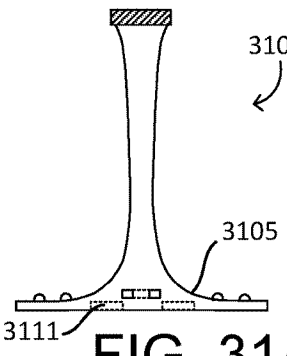
Figure 31B:
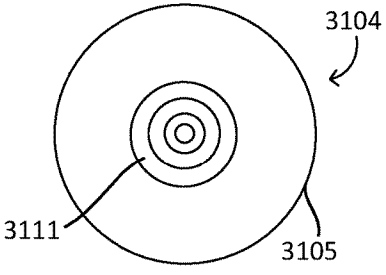
Figure 31C:
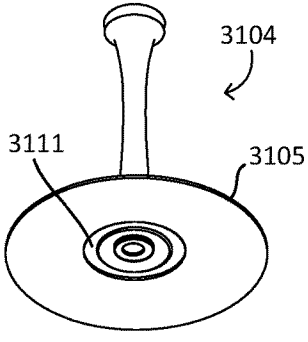

FIGS. 31A-31C are diagrams illustrating, respectively, a cross-sectional view, a plan view, and a perspective, underside view of a base 3104 of a collapsible vessel. As shown in FIGS. 31A-31C, the base 3104 can include a foot 3105. In this example, retention features 3110, implemented as a single recessed, circular feature, can be incorporated in, or formed on a bottom surface of the foot 3105. In a stacked arrangement, the foot 3105 can be placed in contact with an attachment assembly of another vessel. In such a stacked arrangement, the retention features 3110 of the foot 3105, and complimentary retention features of the corresponding attachment assembly can interface, interlock, and/or interfere with each other, e.g., to help prevent relative lateral and/or rotational movement of the vessels.

Figure 32A:
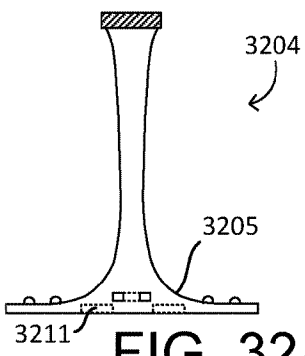
FIGS. 29A-29C, 30A-30C, 31A-31C and 32A-32C are diagrams illustrating various views of respective collapsible vessel bases.
Figure 32B:
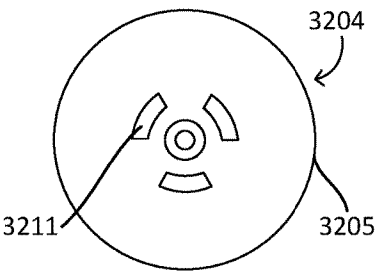
Figure 32C:
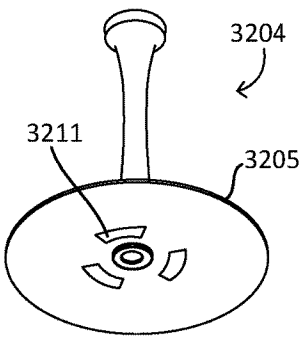

FIGS. 32A-32C are diagrams illustrating, respectively, a cross-sectional view, a plan view, and a perspective, underside view of a base 3204 of a collapsible vessel. As shown in FIGS. 32A-32C, the base 3204 can include a foot 3205. In this example, retention features 3210, implemented as a segmented recessed, circular feature, can be incorporated in, or formed on a bottom surface of the foot 3205. In a stacked arrangement, the foot 3205 can be placed in contact with an attachment assembly of another vessel. In such a stacked arrangement, the retention features 3210 of the foot 3205, and complimentary retention features of the corresponding attachment assembly can interface, interlock, and/or interfere with each other, e.g., to help prevent relative lateral and/or rotational movement of the vessels.

Figure 33A:
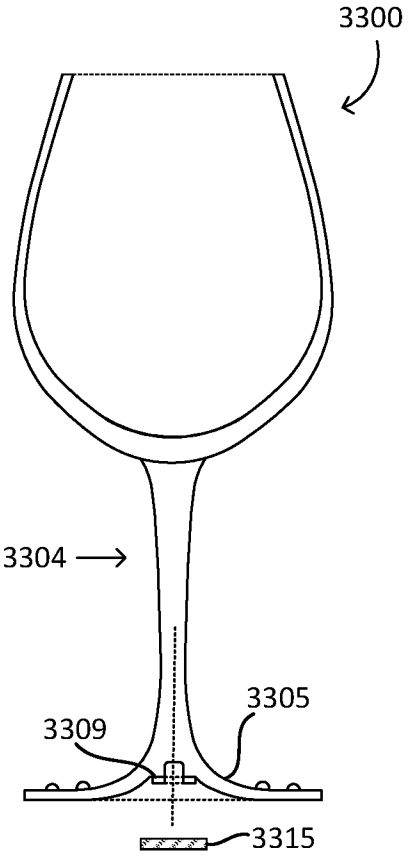
FIGS. 33A-33D and 34A-34D are diagrams illustrating various views of a vessel with an attached ornamental feature.
Figure 33B:
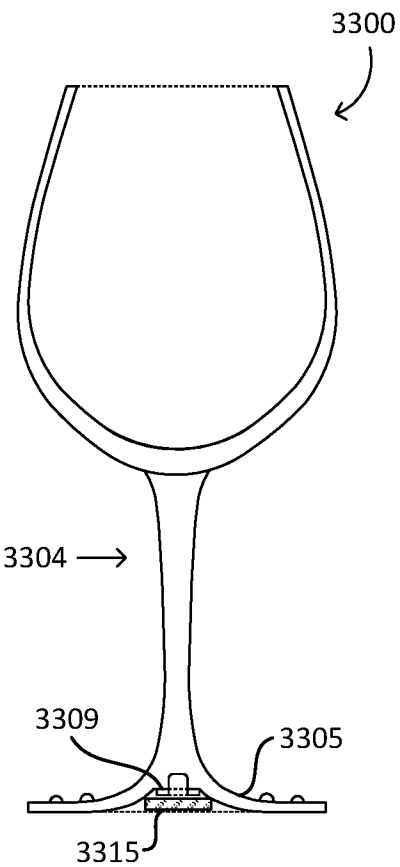
Figure 33C:
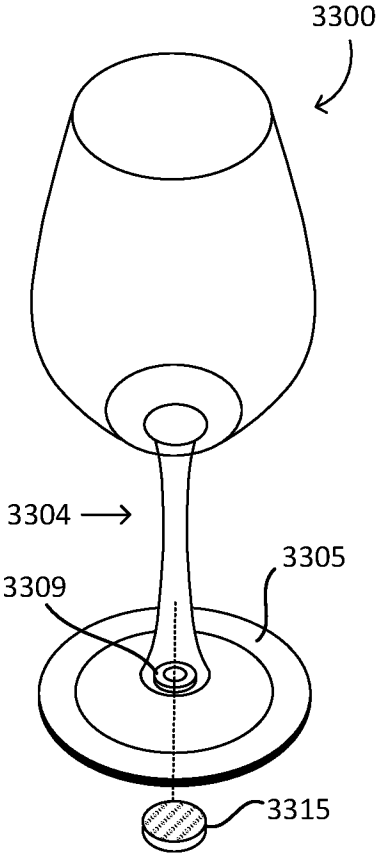
Figure 33D:
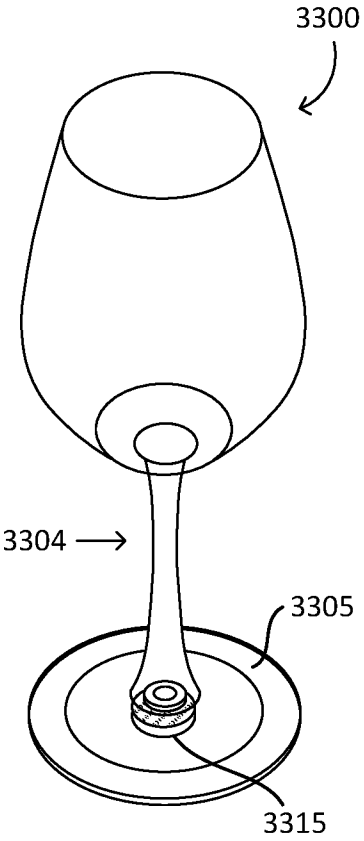
Figures 34A, 34B, 34C, 34D:
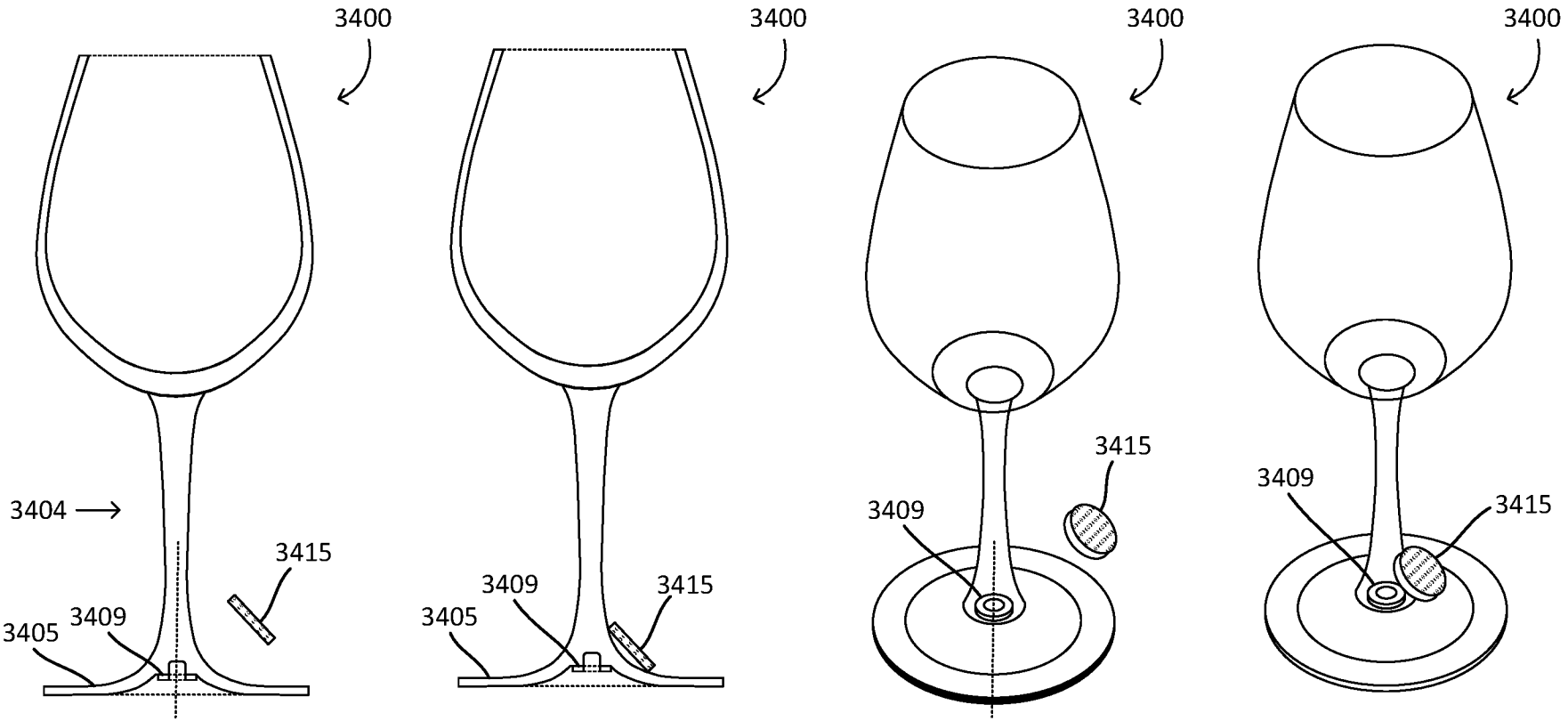

FIGS. 33A-33D and 34A-34D are diagrams illustrating various views of vessels with an attached ornamental feature. FIGS. 33A and 33B are diagrams illustrating cross-sectional views of a vessel 3300 with a decorative element 3315 that is, respectively, separate from the vessel 3300 and attached to a base 3305 of the vessel 3300 via a magnetic element 3309. FIGS. 33C and 33D are diagrams illustrating perspective views corresponding, respectively, with FIG. 33A and FIG. 33B. FIGS. 34A and 34B are diagrams illustrating cross-sectional views of a vessel 3400 with a decorative element 3415 that is, respectively, separate from the vessel 3400 and attached to a base 3405 of the vessel 3400 via a magnetic element 3409. FIGS. 34C and 34D are diagrams illustrating perspective views corresponding, respectively, with FIG. 34A and FIG. 34B.

The examples of FIGS. 33A-34D illustrate the incorporation of the magnetic elements 3309 and 3409 at or near the bottoms of respective vessel bases 3304 and 3404, e.g., under or on top of respective feet 3305 and 3405 of the bases. Such magnetic elements, in addition to providing stability for vessels in a stacked arrangement, can be used, in some implementations, to magnetically attach such decorative elements to a vessel. Such decorative elements may be of various geometries or colors to adorn a corresponding vessel. As shown in FIGS. 33A-33D, a decorative element 3315 can be attached to a vessel 3300 on a bottom of a foot 3305 of a base 3304 of the vessel 3300 or, as shown in FIGS. 34A-34D, a decorative element 3415 can be attached on a top surface of the foot of the base. In some implementations, such decorative elements can be attached to any surface where a magnetic force sufficient to keep the decorative element in place is present, such as using a magnetic force associated with an attachment assembly, such as those described herein. As shown in FIGS. 33A-34D, the vessel 3300 or the vessel 3400 can be one piece, though, in some implementations, can be implemented using a multi-piece, collapsible vessel, such as those described herein.

In a general aspect, a multi-piece vessel can include a body defining an interior volume. The body can include a closed end, and an open end opposite the closed end. The multi-piece vessel can further include a base having a foot arranged in a plane. The base can include a stem arranged along a longitudinal axis that is orthogonal to the plane, and a first magnetic element disposed at an end of the stem that is distal from the foot. The multi-piece vessel can also include an attachment assembly coupled with the closed end of the body, the attachment assembly having a second magnetic element configured to form a magnetic coupling with the first magnetic element, and a retention feature defined on a surface of the attachment assembly distal from the body. The retention feature can be configured to reduce lateral movement of the base relative to the body while the base is magnetically coupled with the attachment assembly.

Implementations can include one or more of the following features. For example, the attachment assembly can be coupled with the body via at least one of an adhesive connection, a friction connection, or an interference connection. The first magnetic element can include a magnet. The second magnetic element can include a magnetically attractive metal.

The second magnetic element and the retention feature can be monolithically integrated. The retention feature can be a first retention feature. The multi-piece vessel can include a second retention feature included at the end of the stem that is distal from the foot. The second retention feature, in conjunction with the first retention feature, can be configured to reduce lateral movement of the base relative to the body while the base is magnetically coupled with the attachment assembly. The first retention feature can include at least one of a protrusion or recess, and the second retention feature can include a respective, complimentary recess or protrusion.

In the nested arrangement, the base can be held in place, at least in part, by magnetic attraction between the first magnetic element and the second magnetic element. An opening of the open end of the body can have a first diameter, and the foot can have a second diameter that is greater than the first diameter. The multi-piece vessel can include an alignment feature included on a surface of the foot. The alignment feature can be configured to reduce lateral movement of the body relative to the base when the stem is inserted in the interior volume of the body in a nested arrangement, and the opening of the open end of the body is in contact with the foot.

The attachment assembly can be configured such that the coupled body and attachment assembly, separate from the base, are free-standing with the surface of the attachment assembly that is distal from the body being disposed on a countersurface.

The multi-piece vessel, in a nested configuration with the stem inserted, at least partially, within the interior volume of the body can be configured to be positioned in a stacked arrangement with another, like multi-piece vessel in the nested configuration. The attachment assembly, while the multi-piece vessel is in the stacked arrangement with the other, like multi-piece vessel, can be in contact with one of a foot of the other, like multi-piece vessel, or an attachment assembly of the other, like compatible vessel. The retention feature, in the stacked arrangement, can reduce lateral movement of the other, like multi-piece vessel with respect to the multi-piece vessel.

The foot, while the multi-piece vessel is in the stacked arrangement with the other, like multi-piece vessel, can be in contact with an attachment assembly of the other, like compatible vessel. The foot can have a third magnetic element disposed therein. In the stacked arrangement, the other, like multi-piece vessel can be held in place, at least in part, by magnetic attraction between the third magnetic element and the attachment assembly of the other, like multi-piece vessel.

The foot, while the multi-piece vessel is in the stacked arrangement with the other, like multi-piece vessel, can be in contact with a foot of the other, like multi-piece vessel. The foot of the multi-piece vessel and the foot of the other, like multi-piece vessel can include complimentary retention features configured to reduce lateral movement of the other, like multi-piece vessel with respect to the multi-piece vessel in the stacked arrangement. The multi-piece vessel can include a third magnetic element disposed in the foot. In the stacked arrangement, the other, like multi-piece vessel can be held in place, at least in part, by magnetic attraction between the third magnetic element and a magnetic element included in the foot of the other, like multi-piece vessel.

The multi-piece vessel can include a third magnetic element disposed in the foot. The third magnetic element can include a magnet that is concentric with the stem along the longitudinal axis. The magnet of the third magnetic element can be configured to magnetically couple at least one magnetically-attractive, ornamental element with the foot.

In another general aspect, a multi-piece vessel can include a body defining an interior volume. The body can include a closed end, and an open end opposite the closed end. An opening of the open end can have a first diameter. The multi-piece vessel can also include a base. The base can include a foot arranged in a plane. The foot can have a second diameter that is greater than the first diameter. The base can further include a stem arranged along a longitudinal axis that is orthogonal to the plane, a first magnetic element disposed at an end of the stem that is distal from the foot, and an alignment feature included on a surface of the foot. The alignment feature can be configured to reduce lateral movement of the body relative to the base when the stem is inserted in the interior volume of the body in a nested arrangement, and the opening of the open end of the body is in contact with the foot. The base can further include a first retention feature included at the end of the stem that is distal from the foot. The multi-piece vessel can include an attachment assembly coupled with the closed end of the body. The attachment assembly can include a second magnetic element configured to form a magnetic coupling with the first magnetic element. The attachment assembly can also include a second retention feature defined on a surface of the attachment assembly distal from the body. The first retention feature and the second retention feature can be configured to cooperatively reduce lateral movement of the base relative to the body while the base is magnetically coupled with the attachment assembly.

Implementations can include one or more of the following features. For example, the multi-piece vessel, in the nested arrangement, can be configured to be positioned in a stacked arrangement with another, like multi-piece vessel in the nested configuration.

In another general aspect, a vessel can include a body having an interior volume and an opening at the top. The body can be configured to receive hold, or dispense a substance. The vessel can also include a base coupled with the body. The base can have a first magnetic element that is included in, or coupled with the base. The vessel can further include a separable decorative element that can include a second magnetic element configured to form a magnetic connection with the first magnetic element, such that the separable decorative element magnetically couples with the base.

Implementations can include one or more of the following features. For example, the first magnetic element can include at least one of a first magnet or a first magnetically attractive material. The second magnetic element can include at least one of second magnet or a second magnetically attractive material.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments.

What is claimed is:

1. A multi-piece vessel comprising:

a body defining an interior volume, the body including:
- a closed end; and
- an open end opposite the closed end;

a base including:
- a foot arranged in a plane;
- a stem arranged along a longitudinal axis that is orthogonal to the plane; and
- a first magnetic element disposed at an end of the stem that is distal from the foot; and an attachment assembly coupled with an outer surface of the closed end of the body, the attachment assembly including:
- a second magnetic element configured to form a magnetic coupling with the first magnetic element; and
- a retention feature defined on a surface of the attachment assembly distal from the body, the retention feature being configured to reduce lateral movement of the base relative to the body while the base is magnetically coupled with the attachment assembly, the attachment assembly being shaped to match a contour of the outer surface of the closed end of the body.

2. The multi-piece vessel of claim 1, wherein the attachment assembly is coupled with the body via at least one of an adhesive connection, a friction connection, or an interference connection.

3. The multi-piece vessel of claim 1, wherein:

the first magnetic element includes a magnet; and the second magnetic element includes a magnetically attractive metal.

4. The multi-piece vessel of claim 1, wherein the second magnetic element and the retention feature are monolithically integrated.

5. The multi-piece vessel of claim 1, wherein the retention feature is a first retention feature, the multi-piece vessel further including a second retention feature included at the end of the stem that is distal from the foot, the second retention feature, in conjunction with the first retention feature, being configured to reduce lateral movement of the base relative to the body while the base is magnetically coupled with the attachment assembly.

6. The multi-piece vessel of claim 5, wherein the first retention feature includes at least one of a protrusion or recess and the second retention feature includes a respective, complimentary recess or protrusion.

7. The multi-piece vessel of claim 1, wherein, in a nested arrangement, the base is held in place, at least in part, by magnetic attraction between the first magnetic element and the second magnetic element.

8. The multi-piece vessel of claim 7, wherein an opening of the open end of the body has a first diameter, and the foot has a second diameter that is greater than the first diameter, the multi-piece vessel further comprising an alignment feature included on a surface of the foot, the alignment feature being configured to reduce lateral movement of the body relative to the base when the stem is inserted in the interior volume of the body in the nested arrangement, and the opening of the open end of the body is in contact with the foot.

9. The multi-piece vessel of claim 1, wherein the attachment assembly is configured such that the coupled body and attachment assembly, separate from the base, are free-standing with the surface of the attachment assembly that is distal from the body being disposed on a countersurface.

10. The multi-piece vessel of claim 1, wherein the retention feature includes at least one of a protrusion or a recess.

11. The multi-piece vessel of claim 1, wherein the multi-piece vessel, in a nested configuration with the stem inserted, at least partially, within the interior volume of the body is configured to be positioned in a stacked arrangement with another, like multi-piece vessel in the nested configuration.

12. The multi-piece vessel of claim 11, wherein the attachment assembly, while the multi-piece vessel is in the stacked arrangement with the other, like multi-piece vessel, is in contact with one of:

a foot of the other, like multi-piece vessel; or an attachment assembly of the other, like compatible vessel, the retention feature, in the stacked arrangement, reducing lateral movement of the other, like multi-piece vessel with respect to the multi-piece vessel.

13. The multi-piece vessel of claim 11, wherein:

the foot, while the multi-piece vessel is in the stacked arrangement with the other, like multi-piece vessel, is in contact with an attachment assembly of the other, like compatible vessel;

the foot has a third magnetic element disposed therein, and in the stacked arrangement, the other, like multi-piece vessel is held in place, at least in part, by magnetic attraction between the third magnetic element and the attachment assembly of the other, like multi-piece vessel.

14. The multi-piece vessel of claim 11, wherein the foot, while the multi-piece vessel is in the stacked arrangement with the other, like multi-piece vessel, is in contact with a foot of the other, like multi-piece vessel.

15. The multi-piece vessel of claim 14, wherein the foot of the multi-piece vessel and the foot of the other, like multi-piece vessel include complimentary retention features configured to reduce lateral movement of the other, like multi-piece vessel with respect to the multi-piece vessel in the stacked arrangement.

16. The multi-piece vessel of claim 14, further comprising a third magnetic element disposed in the foot, wherein, in the stacked arrangement, the other, like multi-piece vessel is held in place, at least in part, by magnetic attraction between the third magnetic element and a magnetic element included in the foot of the other, like multi-piece vessel.

17. The multi-piece vessel of claim 1, further comprising a third magnetic element disposed in the foot, the third magnetic element include a magnet that is concentric with the stem along the longitudinal axis, the magnet of the third magnetic element being configured to magnetically couple at least one magnetically-attractive, ornamental element with the foot.

18. A multi-piece vessel comprising:

a body defining an interior volume, the body being formed of a first material and including:

a closed end;

an open end opposite the closed end, an opening of the open end having a first diameter;

a base including:

a foot arranged in a plane, the foot having a second diameter that is greater than the first diameter;

a stem arranged along a longitudinal axis that is orthogonal to the plane;

a first magnetic element disposed at an end of the stem that is distal from the foot;

an alignment feature included on a surface of the foot, the alignment feature being configured to reduce lateral movement of the body relative to the base when the stem is inserted in the interior volume of the body in a nested arrangement, and the opening of the open end of the body is in contact with the foot; and a first retention feature included at the end of the stem that is distal from the foot; and an attachment assembly coupled with an outer surface of the closed end of the body, the attachment assembly including:

an attachment element formed from a second material different than the first material, the attachment element including a second retention feature defined on a surface; and a second magnetic element coupled with the attachment element, the second magnetic element configured to form a magnetic coupling with the first magnetic element, the first retention feature and the second retention feature being configured to cooperatively reduce lateral movement of the base relative to the body while the base is magnetically coupled with the attachment assembly.

19. The multi-piece vessel of claim 18, wherein the multi-piece vessel, in the nested arrangement, is configured to be positioned in a stacked arrangement with another, like multi-piece vessel in the nested arrangement.

20. The multi-piece vessel of claim 1, further comprising:

a third magnetic element that is included in, or coupled with the foot; and a separable decorative element including a fourth magnetic element configured to form a magnetic connection with the third magnetic element, such that the separable decorative element magnetically couples with the foot.

21. The multi-piece vessel of claim 20, wherein:

the third magnetic element includes at least one of a first magnet or a first magnetically attractive material; and the fourth magnetic element includes at least one of a second magnet or a second magnetically attractive material.

* * * * *